US006483407B1

(12) United States Patent
Matsuda et al.

(10) Patent No.: US 6,483,407 B1
(45) Date of Patent: Nov. 19, 2002

(54) ELECTROMAGNETIC RELAY

(75) Inventors: Kazuhisa Matsuda; Muneo Nakata; Nobuyoshi Kubota; Kenichi Matsuo, all of Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/914,798

(22) PCT Filed: Mar. 2, 2000

(86) PCT No.: PCT/JP00/01218

§ 371 (c)(1),
(2), (4) Date: Sep. 5, 2001

(87) PCT Pub. No.: WO00/54296

PCT Pub. Date: Sep. 14, 2000

(30) Foreign Application Priority Data

Mar. 5, 1999 (JP) ..... 11-059506
Mar. 8, 1999 (JP) ..... 11-059571
Mar. 8, 1999 (JP) ..... 11-059647

(51) Int. Cl.[7] ..... H01H 51/22; H01H 13/04; H01H 9/02

(52) U.S. Cl. ..... 335/78; 335/202

(58) Field of Search ..... 335/78–86, 128, 335/202

(56) References Cited

U.S. PATENT DOCUMENTS 4,686,500 A 8/1987 Ide et al. ..... 335/128

FOREIGN PATENT DOCUMENTS

| | | |
|---|---|---|
| EP | 0 189 921 A2 | 8/1986 |
| JP | 61-176025 | 8/1961 |
| JP | 6-93234 | 7/1981 |
| JP | 3-12198 | 3/1991 |
| JP | 3-126340 | * 12/1991 |
| JP | 4-12242 | 1/1992 |
| JP | 10-162712 | 6/1998 |
| JP | 10-188762 | 7/1998 |

OTHER PUBLICATIONS

Australian Patent Abstract AU–A–52894/86.
Canadian Patents Issued Sep. 13, 1988 CA–A–1,241,988.

* cited by examiner

*Primary Examiner*—Ramon M. Barrera
(74) *Attorney, Agent, or Firm*—Morrison & Foerster, LLP

(57) ABSTRACT

In an electromagnetic relay wherein one of the flanges 2*b* of the spool 2 is located inside of the opening of the case and a stationary terminal 11 is attached to this spool 2, the problem of dust occurrence due to the attachment of the stationary terminal 11 is solved so as to implement the attachment of the stationary terminal (in particular, a portion to which a stationary contact point 10 is provided) in an excellent condition. In order to achieve this, protruding portions 11*e* and 11*f* extending from the stationary terminal 10 are compressively inserted into through holes 2*e* and 2*f* configured in the flange 2*b* and the vicinity of the stationary contact point of the stationary terminal 11 is engaged with the engagement portion 2*f* formed on the other flange 2*a* and, thereby, the stationary terminal 11 is attached to this structure.

1 Claim, 14 Drawing Sheets

(a)

(b)

(a)

(b)

ELECTROMAGNETIC RELAY

TECHNICAL FIELD

The present invention relates to an electromagnetic relay wherein one of the flanges of the spool is arranged inside of an opening of a case and a stationary terminal is attached to this spool. In particular, the invention relates to an electromagnetic relay wherein the problem of dust occurring at the time of the attachment of the stationary terminal is solved and the stationary terminal (in particular, a portion where a stationary contact point is provided). can be implemented so as to become attached in an excellent condition.

BACKGROUND TECHNOLOGY

In general, in an electromagnetic relay a movable contact point and a stationary contact point are arranged on the side (hereinafter referred to, in some cases, as the rear side of the case) opposite to the terminal side where the edges for connection of the terminals are lead out. Then, as for the above electromagnetic relay, in many structures the movable contact point shifts in the direction of the coil axis so that the switching with respect to the stationary contact point is carried out to the conductive condition (contact condition). In such an electromagnetic relay of a conventional type, as may be seen in Japanese unexamined patent publication S56(1981)-93234 (first prior art), the stationary terminal, wherein a stationary contact point is secured on one end, is attached by a manner such as compressive insertion to a thick portion provided in a flange, located on the rear side of the case of a spool made of resin around which a coil is wound. Here, as may be seen in FIG. 2 of Japanese examined utility model publication H3(1991)-12198 (second prior art), there is also a type where the other side of the stationary terminal (edge portion for connection) is pushed into a base (substrate) which is arranged outside of the flange on the side of the terminal of the spool in a condition of penetration so as to support and fix the stationary terminal.

Here, in recent years, miniaturization and cost reduction have been increasingly required for a compact type electromagnetic relay (small type where the dimension of height is, for example, 20 mm, or less) which is mounted on a circuit substrate, or the like, in order to be mounted in a car. Therefore, further reduction of the number of portions and assembly structure of each portion in a high density have become important. Therefore, as is disclosed in Japanese unexamined patent publication H10(1998)-162712 (third prior art), a type of relay wherein one of the flanges of the spool is made to function as a base has appeared. That is to say, a member called a base which is conventionally the foundation of the assembly is eliminated and one of the flanges of the spool around which a coil of the electromagnet is wound is arranged inside of the opening of the case in the relay.

In addition, in this type of compact electromagnetic relay, which is the most widely used type,, the relay is usually sealed (that is to say, sealed type relay) in order to withstand cleaning after the mounting of the substrate or in order to secure a predetermined waterproof or dustproof condition. In particular, the cleaning of the above is carried out after soldering for the mounting of the substrate. Therefore, the relay is rapidly cooled down from the heated condition by a cleaning liquid. As a result of this, a difference in atmospheric pressure occurs between the inside and the outside of the relay so that the cleaning liquid is easily absorbed into the inside even through a slight gap and, therefore, an extreme airtightness is required.

DISCLOSURE OF THE INVENTION (Technical Problem to be Solved by the Invention)

In the above conventional relay there is the problem that defects in performance are easily caused by dust which occurs due to the attachment of the stationary terminal. In addition, in the above conventional relay there is the problem that a stationary terminal (in particular, a portion where a stationary contact point is provided) cannot be implemented so as to achieve the attachment in an excellent condition.

More precisely, in the case of the first stationary terminal is secured to the flange located in the rear side of the case of the spool in the vicinity of the stationary contact point by a manner such as compressive insertion. Therefore, at the time of this securing, the resin material forming the spool is shaved by the stationary terminal, which is of metal, so that an insulating dust (shavings) occurs and this dust easily enters in between the points of contact. As a result of this, the possibility of the occurrence of the obstruction of the points of contact (fluctuation of contact resistance, defective conductance of the contact point, or the like) due to the above dust is high.

In addition, in the first prior art a structure where the flange on the rear side of the case is secured in the vicinity of the stationary contact point of the stationary terminal is provided. Therefore, the position (in particular, the position in the direction of the coil axis) of the stationary contact point changes due to deformation (warping) of the above flange in the direction of the coil axis and the contact pressure changes and, therefore, an excessive dispersion of the operational characteristics easily occurs.

That is to say, a force (i.e. pressure in the direction of the coil axis) works so that the tightly wound coil in the spool of an electromagnetic relay is led to the outside. In particular, the flange of the spool is thin in the compact (small-sized) electromagnetic relay as described previously. Thereby, a considerable amount of deformation (warping) in the form of a curved surface occurs in the flange of the spool due to the above pressure in the direction of the coil axis. As a result of this, the stationary contact point is also displaced due to the above deformation and, therefore, there is the risk that the characteristics differ greatly from the design value.

Here, a shift in the position of the contact point in the lateral direction has a comparatively small effect on the characteristics such as contact resistance and can be covered by the contact size. However, the displacement of the stationary contact point in the direction of contact (that is to say, the direction of the coil axis) along which the movable contact point shifts greatly affects the contact pressure and causes a great fluctuation in the operational characteristics and, therefore, this is, in particular, a problem.

On the other hand, in the case of the second prior reference, the place to which the stationary terminal is secured by pushing, for instance, for fitting is the base arranged outside of the flange on the terminal side of the spool which is a position far away from the stationary contact point or from the movable contact point. Therefore, the possibility of the occurrence of the obstruction of the contact point due to dust, as described above, is comparatively low. In addition, there is no problem of fluctuation in the characteristics due to deformation of the flange. However, the second prior art provides a structure wherein the entirety of a long stationary terminal is supported at only one end portion (side of the end portion for connection). Therefore, it is difficult to maintain the position of the stationary terminal as a whole in a sufficiently fixed manner (to secure the strength) and there is the problem that the positioning precision of the stationary contact point on the side of the other end is poor. Furthermore. when sufficient holding strength is to be assured by increasing supporting distance of the terminal, which has been compressively inserted within the base, then corresponding thickness of the base must become larger. Therefore, there is the disadvantage that the dimensions of the entire relay increases so as to become a larger type or the coil space decreases so that the attraction characteristics of the electromagnet become worse.

In addition, in the electromagnetic relay for mounting on a substrate as described above, of which miniaturization is strongly required, it is necessary to make the base extremely thin. Therefore, in the structure of the attachment of the stationary terminal, such as in the second prior reference described above, the positioning precision of the stationary contact point becomes particularly poor.

Furthermore, in the type where the base is eliminated as described above, the attachment to the base as in the above described first prior art is impossible and the stationary terminal must attached to the spool. Therefore, a structure of the attachment which can solve the above described problems of the first and second prior arts, that is to say, a new structure wherein the stationary terminal is attached to the spool, is required.

Thus, the present invention provides an electromagnetic relay wherein one of the flanges of the spool is arranged inside of the opening of the case and the stationary terminal is attached to this spool. In particular, a purpose of the invention is to provide an electromagnetic relay which solves the problem of dust occurring at the time of the attachment of the stationary terminal and which can implement the stationary terminal (in particular, a portion where the stationary contact point is provided) so as to achieve the attachment in an excellent condition.

(Means for Solving the Problem and Improved Working Effects in Comparison with the Prior Art)

To achieve the above purpose an electromagnetic relay according to Claim 1 is characterized in that, in an electromagnetic relay which is covered by a case of which the side of one end is open, wherein one of the flanges of the spool around which the coil of the electromagnet is wound is arranged inside of the opening of the above case and the other flange of the above spool is arranged on the rear side of the above case and which has a stationary terminal of which the stationary contact point is provided at a tip which extends towards the rear side of the above case, a protruding portion extending from the above stationary terminal is compressively inserted in a hole created in the above first flange and an engagement portion formed in the above second flange is engaged in the vicinity of the stationary contact point of the above stationary terminal and, thereby, the above stationary terminal is attached to the spool.

Accordingly, in the electromagnetic relay according to the present invention, the protruding portion extending from the stationary terminal is compressively inserted into the hole formed in one of the flanges of the spool arranged on the side of the case with the opening and the engagement portion formed in the other flange arranged on the rear side of the case is engaged to the vicinity of the stationary contact point of the stationary terminal and, thereby, the stationary terminal is attached to the spool.

Thereby, the stationary terminal is supported with the sides of both ends so that a sufficient positioning precision can be gained without making the insertion dimensions large by making the flange thick. In addition, the stationary terminal is supported through a simple engagement without being compressively inserted in the vicinity of the contact point. Therefore, the possibility of causing contact obstruction due to the invasion of shavings (dust), which occurs through compressively inserting process, between the points of contact is remarkably reduced.

In addition, an electromagnetic relay according to Claim 2 is characterized in that the above engagement portion regulates only a shift of the above stationary terminal in the lateral direction perpendicular to the direction of the coil axis and the above stationary terminal can, at least, shift in the direction of the coil axis relative to this engagement portion.

Accordingly, even in the case that the flange becomes deformed in a manner of warping into the form of a curved surface due to the above pressure in the direction of the coil axis, the flange alone is deformed so that the deformation of the above flange is avoided. Therefore, even when the above deformation occurs, the stationary terminal is not displaced. As a result of this, the displacement of the stationary contact point in the direction of the axis which has the greatest effects on the contact pressure is avoided so that the contact characteristics are significantly stabilized.

In addition, an electromagnetic relay according to Claim 3 is characterized by having a configuration wherein a plurality of pairs of a hole in the first flange and a protruding portion of the above stationary terminal being compressively inserted into this hole in different positions regarding the lateral direction of the above first flange and of the above stationary terminal are provided so that, as for some of the holes and protruding portions, the shift of the protruding portion into the compressively inserting direction is regulated under the attached condition while, as for some other holes and protruding portions, the shift of the protruding portion into the compressively inserting direction becomes possible under the attached condition and wherein the rotation of the entirety of the above stationary terminal accompanying the shift into the compressively inserting direction of the other protruding portions is regulated by the engagement portion of the above second flange and, thereby, the entirety of the above stationary terminal is positioned and the position is maintained while the torque in the direction of the above rotation added to the above stationary terminal at the time of being compressively inserted is maintained.

Accordingly, the stationary terminal is attached under the condition where the vicinity of the stationary contact point is pressed in the lateral direction to the engagement portion. Therefore, though in the above configuration the vicinity of the stationary contact point is not compressively inserted into the flange, the condition is maintained wherein the vicinity of the stationary contact point of the stationary terminal is difficult to shift even in the lateral direction. As a result, a positional shift of the stationary terminal along the lateral direction hardly occurs and the contact characteristics are attained from this view point.

In addition, an electromagnetic relay according to Claim 4 is characterized in that the entire relay is sealed by filling in a sealing material into the side with the opening of the above case and the holes, into which the above protruding portions are compressively inserted, are made to be through holes with openings on the side with the opening of the above case so that the above sealing material is made to enter gaps between these through holes and the above protruding portions.

Accordingly, in the relay according to Claim 4, holes in one of the flanges, into which the above protruding portions are compressively inserted, are created as though holes with openings on the side of the case with the opening so that the sealing material is made to enter into the gaps between these through holes and the above protruding portions. Therefore, most of the shavings occurring due to the compressive insertion of these protruding portions become solidified with the sealing material so that the shift toward the rear side of the case is blocked. As a result of this, the possibility of the occurrence of contact obstruction due to dust is further reduced. In addition, the above protruding portions, which have been compressively inserted, are secured more solidly because of the adhesive effects of the sealing material. Therefore, an appropriate compressive insertion condition is maintained with a high reliability so that the position of the stationary terminal is maintained in an appropriate condition which is even more stable.

An electromagnetic relay according to Claim 5 is characterized in that in an electromagnetic relay of which the side of one end is covered with a case with an opening wherein one of the flanges of the spool around which a coil of an electromagnet is wound is arranged inside of the opening of the above case and a lateral direction plate portion of an L shaped yoke is fit into a recess created on the end side of this first flange so that a longitudinal direction plate portion of this -L shaped yoke is arranged so as to extend from an opening created on the bottom surface of the recess of the above first flange to the side of the other flange of the above spool along the direction of the coil axis of the above spool and wherein a movable contact point spring is secured to outer surface of the longitudinal direction plate portion of the above yoke so that the side of one end of this movable contact point spring extends from the opening of the above case in a protruding condition so as to form an edge portion for connection of the movable contact terminal and which is sealed by filling in a sealing material in the inside of the opening of the above case, a notch facing the above recess and the opening is created on the surface of the side where the above longitudinal direction plate portion is arranged in the above first flange and this notch arranges the side of one end of the above movable contact point spring into the condition of penetration through a window surrounded by the above case and the yoke and the above sealing material is filled in within the above window.

Accordingly,. the electromagnetic relay according to Claim 5 forms a notch facing the recess and the opening into which the yoke is fit on the side of the first flange of the spool. Then, a configuration is provided wherein this notch arranges the side of one end of the movable contact point spring (end portion for connection of the movable contact terminal) into the condition of penetration through a window surrounded by the case and the yoke and the sealing material is filled in within this window.

That is to say, in the present invention a lead portion of the end portion for connection of the movable contact terminal is formed so that this lead portion is sealed. Therefore, it is not necessary to add a portion in a specific form to the spool in order to prevent unnecessary invasion of the sealing material and the height dimension of the entire relay does not become large.

In addition, the operation of penetrating the side of one end of the movable contact point spring into a narrow gap at the time of assembly of the movable contact point spring, and therefore the assembly operation, becomes significantly easier even in the case that the assembly operation is done manually.

In addition, according to the present invention the above movable contact point spring is transferred in a linear manner in the direction of travel from the side of the above spool in the condition, where the above yoke is attached, to the outer surface of the above notch and the above longitudinal direction plate portion, which is in the lateral direction perpendicular to the coil axis direction. Then, the side of one end of the above movable contact point spring is fit into the above notch while the above movable contact point spring is secured to the outer surface of the longitudinal direction plate portion of the above yoke and, thereby, the above movable contact point spring can be attached. Therefore, the assembly of the movable contact point spring before the attachment of the case becomes possible by transferring the movable contact point spring in the lateral direction in a linear manner and, thereby, assembly becomes easy. As a result of this, automatic assembly becomes possible and the effects are gained that high productivity (low production cost) can be implemented.

BEST MODE FOR CARRYING OUT THE INVENTION

In the following, an embodiment of the case where the present invention is applied to a compact electromagnetic relay (sealed type relay) is described in reference to the attached drawings.

Here, in the following, the side of the case opening (lower side in FIGS. 1 and 3) is referred to, accordingly, as the side of the case opening or as the terminal side and the rear side of the case (upper side in FIGS. 1 and 3) is referred to, accordingly, as the rear side of the case. In addition, the direction along the axis core of the spool, that is to say, the direction of the coil axis (upward and downward direction in the FIGS. 1 and 3) is referred to, accordingly, as the longitudinal direction while the direction perpendicular to the above direction of the coil axis is referred to, accordingly, as the lateral direction.

Figure 3:
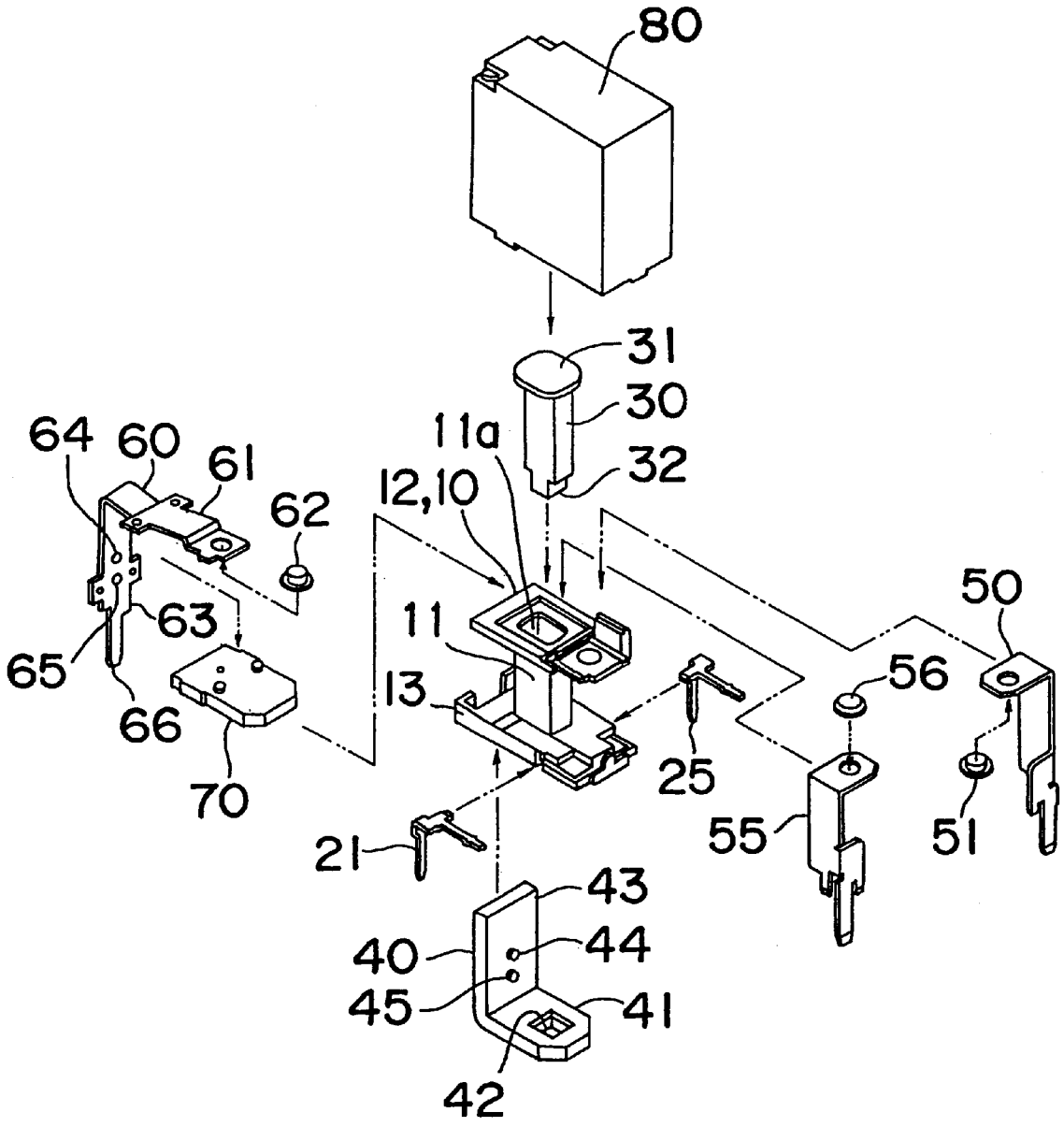
FIG. 3 is an exploded perspective view of the entirety of the electromagnetic relay.

The first embodiment is disclosed in FIGS. 1 to 9. In particular, as shown in FIG. 3, this embodiment comprises a spool 10, a coil 20 (see FIG. 1), a pair of coil terminals 21 and 25, an iron core 30, a yoke 40, a pair of stationary terminals 50 and 55, a movable contact point spring 60 in approximately an L shape form with a movable iron piece 70 and a case 80.

That is to say, the above spool 10 forms an electromagnet by having the coil 20 wound around its body portion 11 and has flanges 12 and 13 on both the upper and lower edges of the above body portion 11.

The above coil terminals 21 and 25 are, respectively, compressively inserted in the flange portion 13 of the above spool 10 and are, respectively, connected with respective lead wires of the above coil 20.

The above iron core 30 is inserted into a through hole 11*a* created within the body portion 11 of the above spool 10 in the longitudinal direction so that a protruding end portion 32 (protrusion for caulking) is stationaryly attached caulking in a caulking hole 42 created in the lateral portion 41 of the yoke 4 in an L shape.

The above first and second stationary terminals 50 and 55 comprise, respectively, the first and second stationary contact points 51 and 56 which are, respectively, attached to the flange portions 12 and 13 of the above spool 10. In particular, the above first stationary contact point 51 is an NC contact point where the movable contact point described below is pressed to make contact at the time of the turning off of the electricity of the coil. In addition, the second stationary contact point 56 is an NO contact point where the movable contact point is pressed to make contact at the time of the turning on of the electricity of the coil.

In the above movable contact point spring 60 the movable iron piece 70 is stationaryly attached caulking to a plate portion 61 which extends in the lateral direction and a movable contact point 62 is stationaryly attached the free edge portion of the plate portion 61. Then, the caulking holes 64 and 65 created in the plate portion 63, which extends in the longitudinal direction movable contact point spring 60, are, respectively engaged to the protrusions 44 and 45 formed on the back side of the vertical portion 43 of the above yoke 40 so as to be stationaryly attached caulking and, thereby, the above movable contact point 62 is located between the stationary contact points 51 and 56. Furthermore, as for the above movable iron piece 70, the base edge side is joined to the vertical portion 43 of the above yoke 4 so as to be attracted to the magnetic pole portion 31 of the iron core 30 at the time of the turning on of the electricity of the coil and the tip end side vibrates. Therefore, the above movable contact point 62 alternately makes contact and breaks off contact with the stationary contact points 51 and 56.

The above case 80 has the opening on the side for assembly (lower side in FIG. 3) and is in a box shape which can be engaged to the lower flange 13 of the above spool 10 and which is covered so as to contain the entirety of the relay (except the edge portions for connection of the terminals).

Accordingly, the relay according to the embodiment of the present invention is a type wherein the flange 13 of the lower portion of the spool 10 is arranged inside of the edge portion of the opening of the case 80 so as to function as a base.

Next, the above components and the attachment structures are concretely and individually described.

Figure 4:
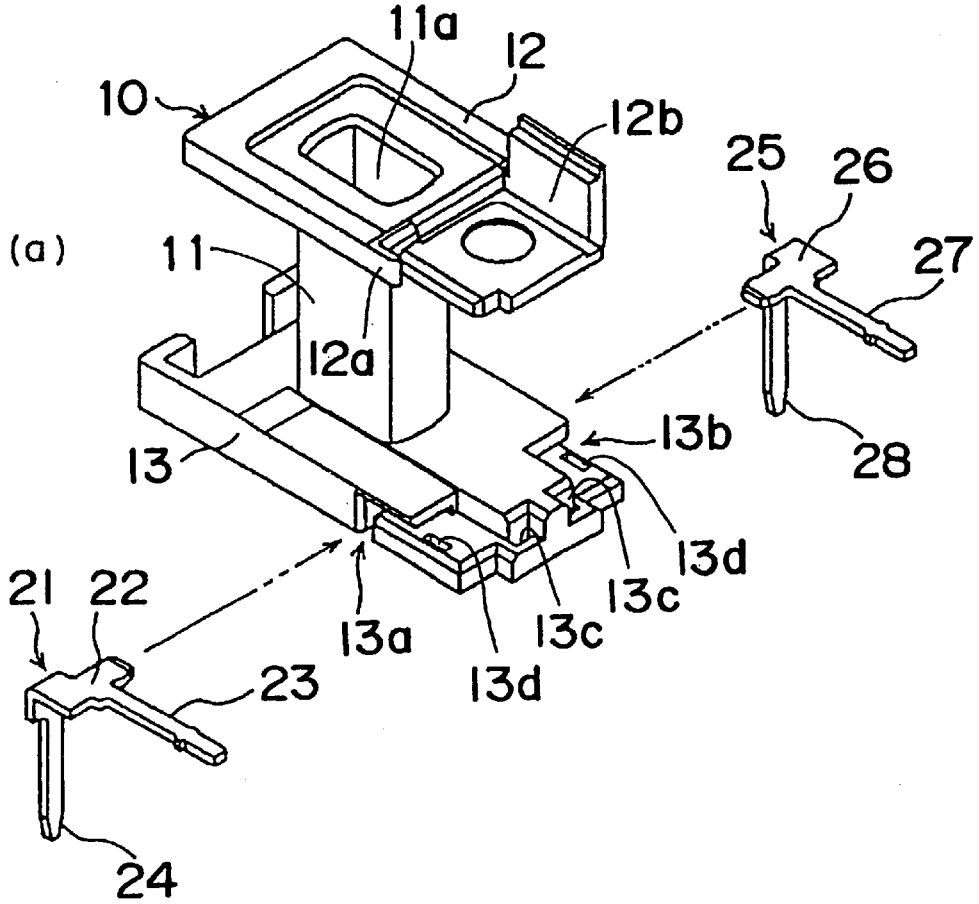
FIGS. 4(*a*) and 4(*b*) are perspective views showing the assembly process of attaching coil terminals to a spool.
Figure 4:
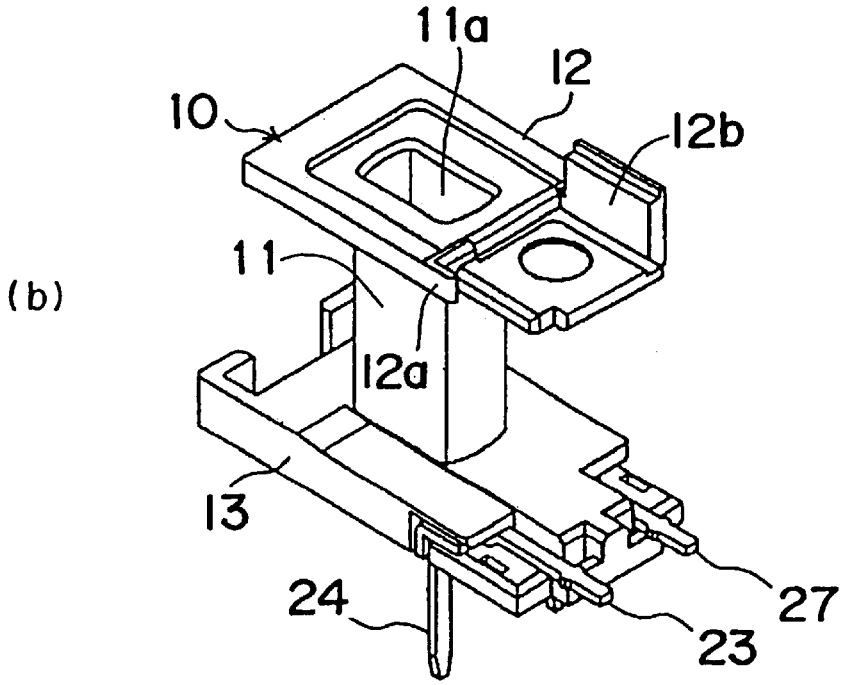

The first coil terminal 21 and the second coil terminal 25 are sometimes in approximately an L shape as a whole, as viewed from the side, before assembly as shown in FIG. 4 (*a*). Then, the coil connection edge portions 23 and 27, respectively, extend. in the lateral direction from the outer edge surface of the broad base plates 22 and 26. In addition, edge portions 24 and 28 for external connection, respectively, extend in the longitudinal direction from the inner edge surface of the base plates 22 and 26.

Figure 1:
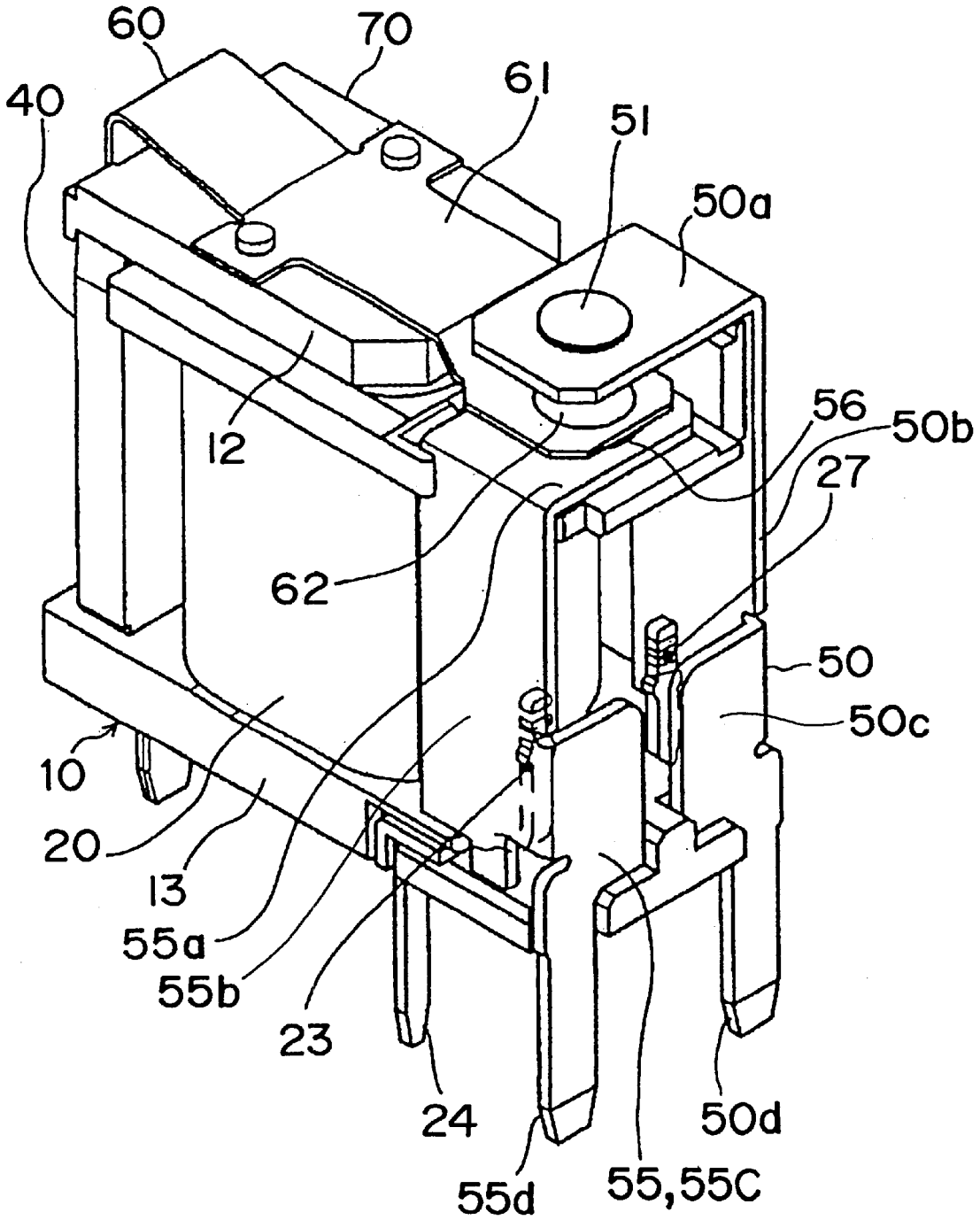
FIG. 1 is a perspective view showing an electromagnetic relay.
Figure 2:
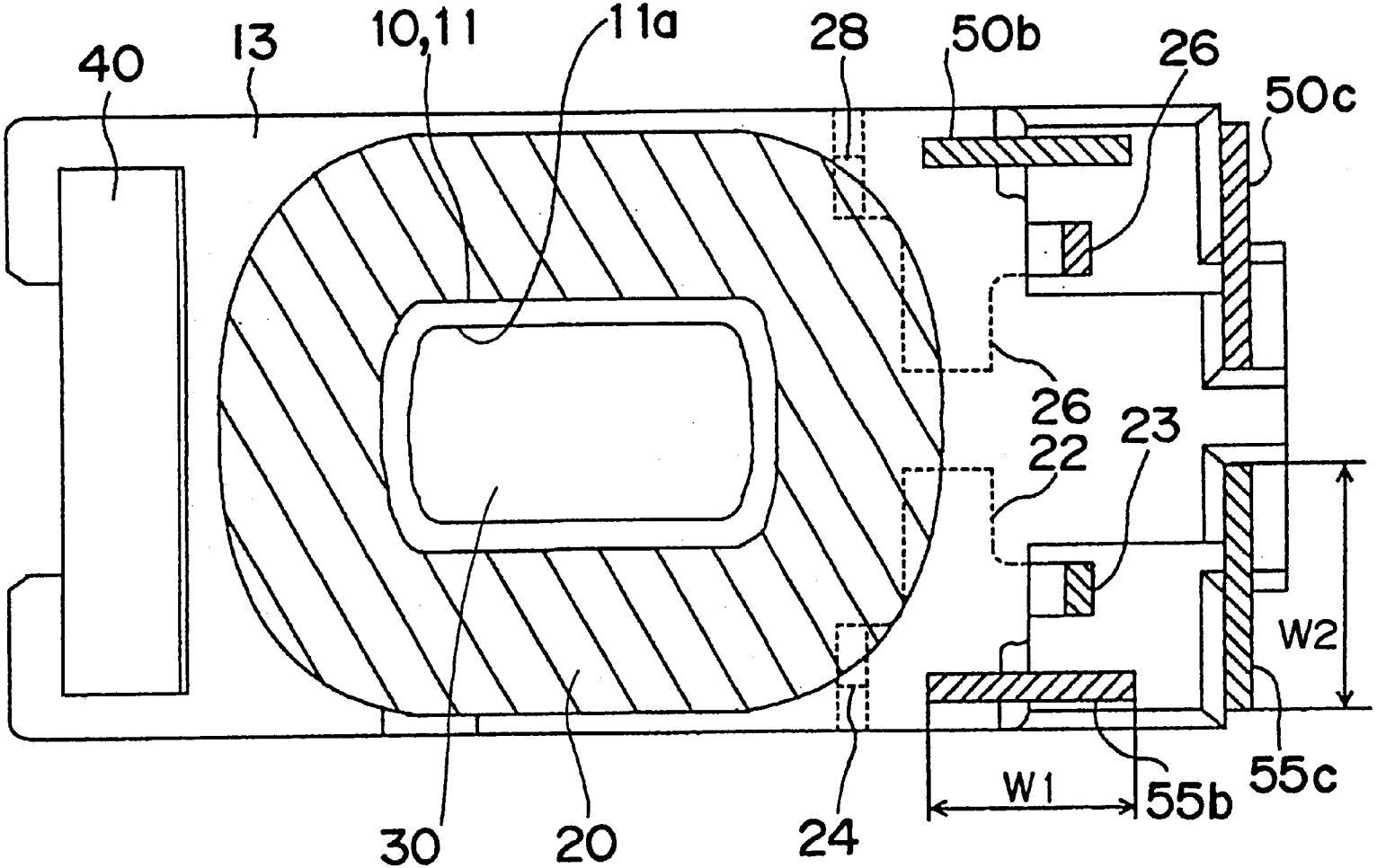
FIG. 2 is a cross section view of FIG. 1.

The coil connection edge portions 23 and 27 of these first and second coil terminals 21 and 25 are bent in the longitudinal direction through the attachment process as described below. Therefore, as shown in FIG. 1 the coil connection edge portions 23 and 27 are, finally, arranged longitudinally within the space of the inside of the above plate portions 50*a* and 55*a* for contact points in the coil axis direction (lower side in FIG. 1), which is on the inside of the above flange 13.

Conventionally it has been difficult to avoid the presence of a comparatively large space surrounded by the longitudinal direction plate portions 50*b* and 55*b* of the stationary terminals 50 and 55 on the lower side of the above contact point plate portions 50*a* and 55*a* in the figures because of the structures of the stationary terminals 50 and 55. According to the relay of the embodiments of the present invention, however, there is the advantage that the above space can be effectively utilized by arranging said coil connection edge portions 23 and 27 within the above space.

Here, the edge portions 24 and 28 for external connection of these first and second coil terminals 21 and 25 extend to the side of the case opening rather than to the flange 13 in the assembled condition so as to be connectable to a predetermined circuit conductor at the time of mounting on the substrate.

The attachment structures of the first and second coil terminals 21 and 25 in the embodiment of the present invention are symmetrical structures as follows.

That is to say, grooves 13*a* and 13*b* extending from the side surface toward the inner side and having an opening on, respectively, the external surface and inner surface of the above flange 13 as shown in FIG. 4(*a*) are created on both sides of the above flange 13. By respectively engaging the coil terminals 21 and 25 with these grooves 13*a* and 13*b*, respective coil terminals 21 and 25 and attached to the flange 13. As a result of this, respective coil connection edge portions 23 and 27 are lead toward the inside from the opening of the inner side of these grooves 13*a* and 13*b*. On the other hand, the respective edge portions 24 and 28 for external connection are lead out to the outside from the opening on the outside of these grooves 13*a* and 13*b*.

The above grooves 13*a* and 13*b* are in the form of an L shape as a whole, as seen from the side of the flange 13. That is to say, the above grooves 13*a* and 13*b* are in the form where the side opening to the inside of the flange 13 extends in the lateral direction parallel to the flange 13 while the side opening to the outside extends in the direction of the coil axis (longitudinal direction) perpendicular to the flange 13. Then, the coil connection edge portions 23 and 27 of the respective coil terminals 21 and 25 are bent to a right angle at the opening in the inside of the respective grooves 13*a* and

13*b* (see FIGS. 1 and 7) so as to extend towards the back side of the above contact point plate portions 50*a* and 55*a* along the direction of the coil axis.

Respective coil terminals 21 and 25, the coil 20 and the stationary terminals 50 and 55 are simply attached as follows.

That is to say, as shown in FIG. 4(*a*), for example, respective coil terminals 21 and 25 (of an L shape before assembly) are transferred in the lateral direction from the side of the flange 13 in a linear manner. Then, they are respectively deeply engaged with the above grooves 13*a* and 13*b* as shown in FIG. 4 (*b*). Next, under this condition, a lead wire is connected to the coil connection edge portion 23 or 27 and a winding process is carried out for the winding around the coil 20. At this time, respective coil connection edge portions 23 and 27 extend in the lateral direction from the inside openings of the grooves 13*a* and 13*b* so as to be in the condition of sticking out from one side surface of flange 13. In order to achieve this, the winding process is easily carried out as follows. That is to say, after the lead wire of one end of the coil 20 is connected to the coil connection edge portion 23, the winding is carried out around the body portion 11 of the spool 10. Then, the lead wire of the other end side of the coil 20 is connected to the coil connection edge portion 27. Finally, the two coil connection edge portions 23 and 27 which stick out from one side surface of the flange 13 are simultaneously dipped in a solder tank so as to be soldered.

Figure 5:
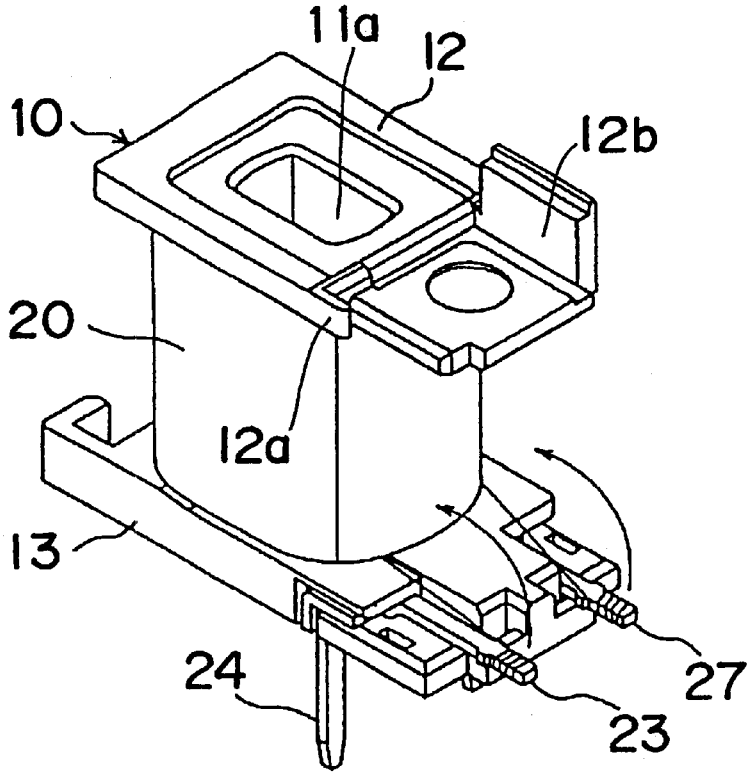
FIGS. 5(*a*) and 5(*b*) are perspective views showing the process of the folding up of the coil terminals after winding a coil around the spool.
Figure 5:
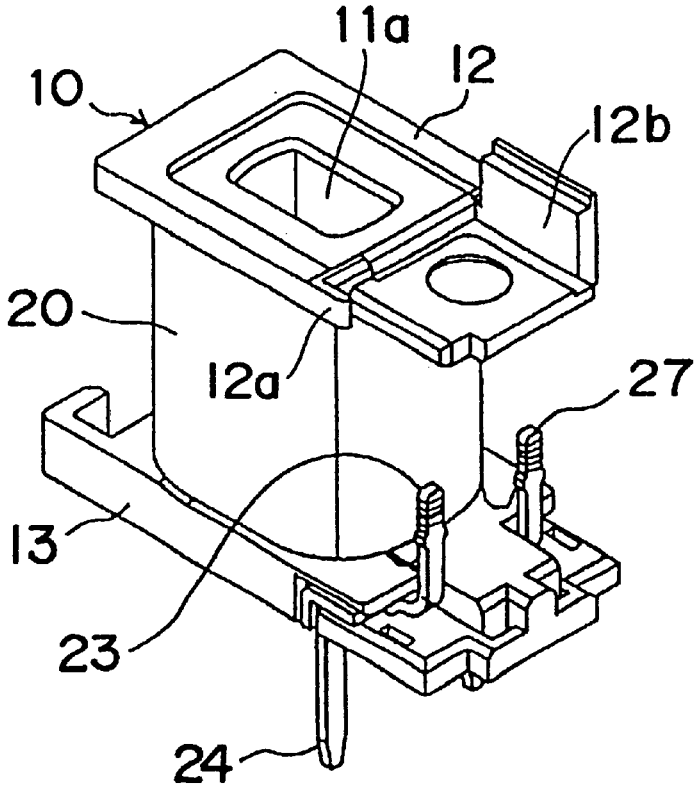
Figure 6:
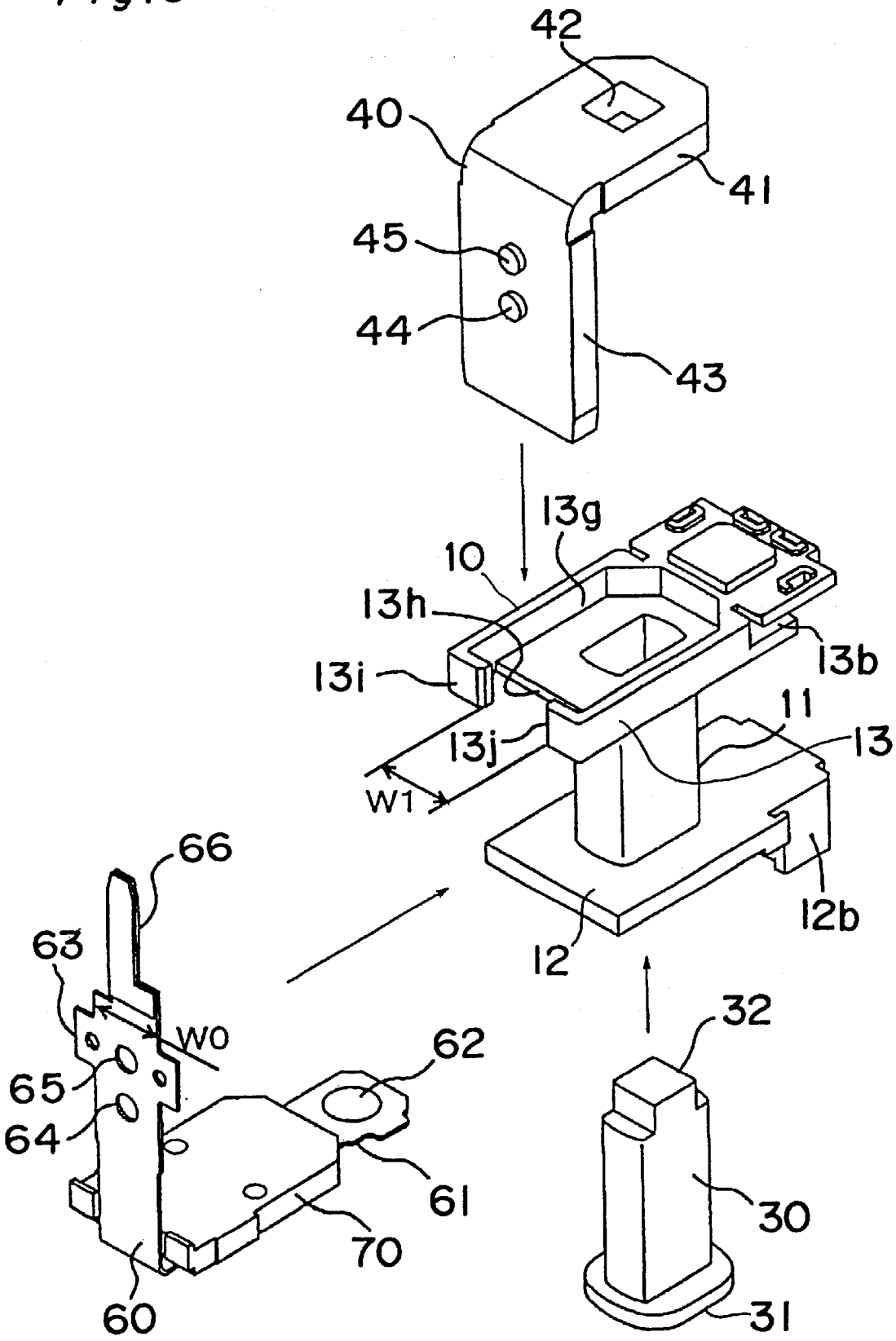
FIG. 6 is a perspective view showing the assembly process of attaching an iron core, a yoke and a movable contact point spring to the spool.

Next, as shown in FIG. 5 (*a*), by adding force in the folding up direction to the respective coil connection edge portions 23 and 27 which stick out from one side surface of the flange 13, the respective coil connection edge portions 23 and 27 are bent to approximately a right angle in the inside of the grooves 13*a* and 13*b*. As a result of this, the entirety of the respective coil connection edge portions 23 and 27 can be contained within the above described space.

Figure 7:
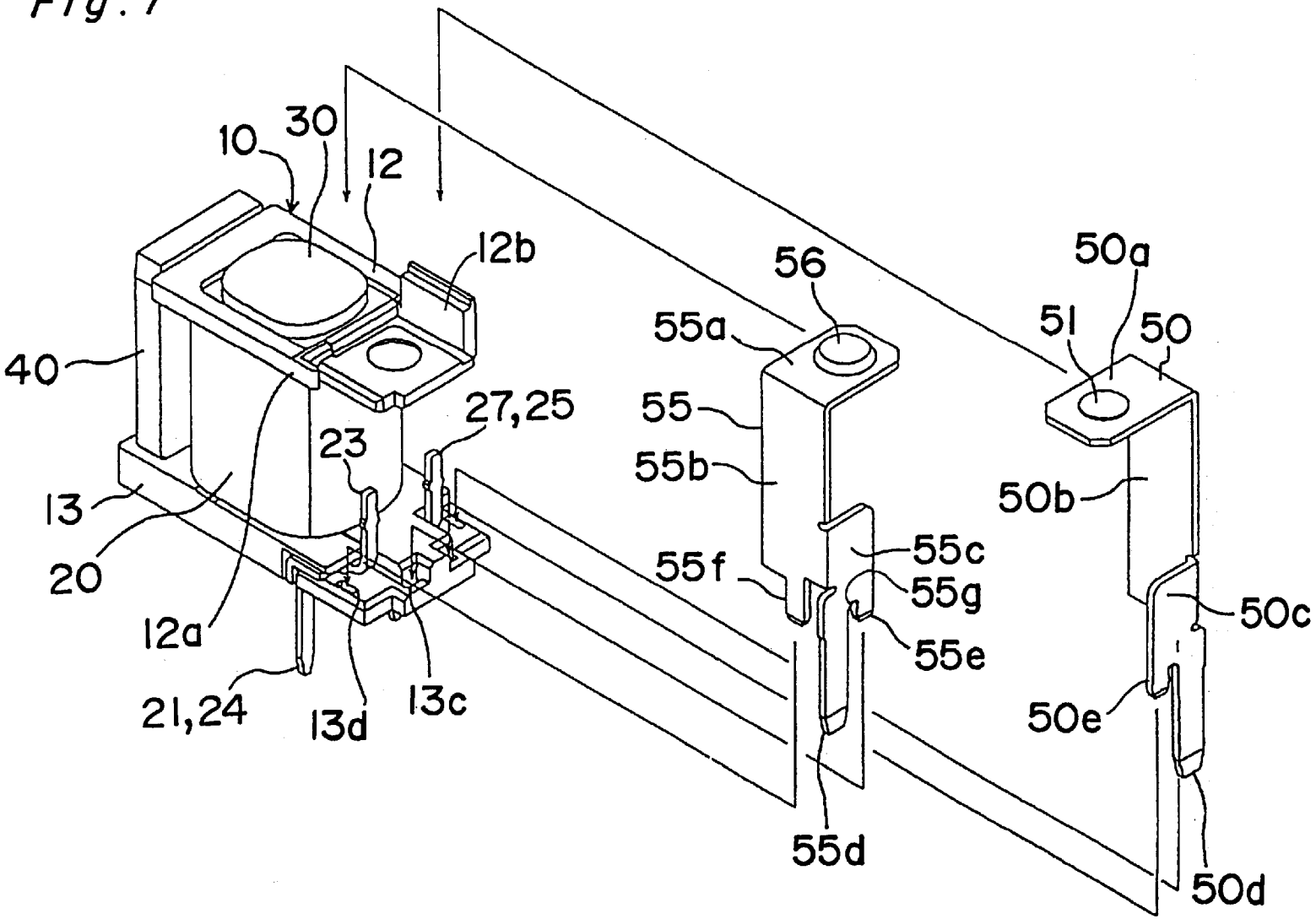
FIG. 7 is a perspective view showing the assembly process of attaching stationary terminals to the spool.
Figure 8:
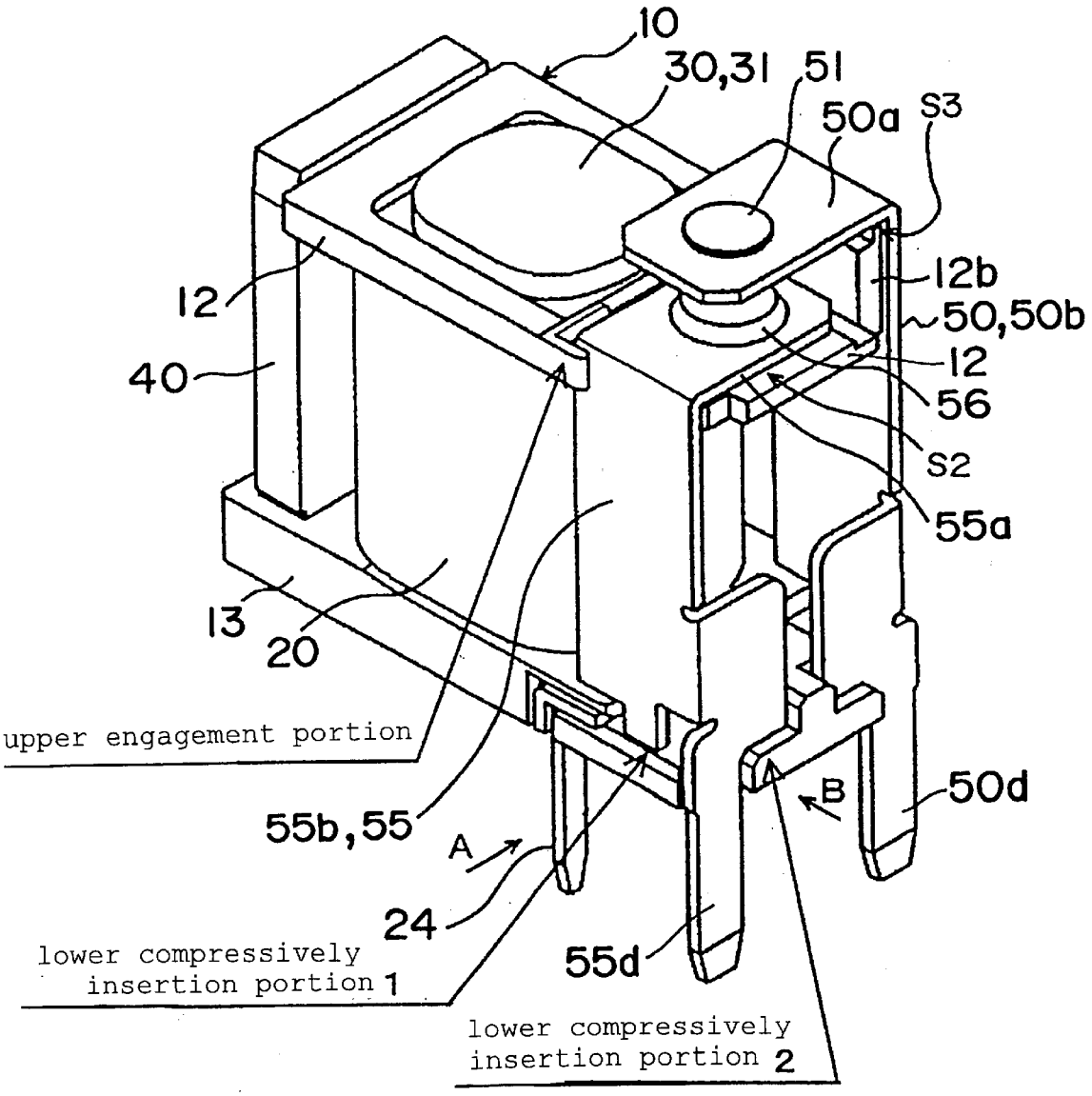
FIG. 8 is a perspective view showing the assembled condition where stationary terminals have been attached to the spool.

Then, as shown in FIG. 7 for example, the first and second stationary terminals 50 and 55 are shifted in a straight manner in the longitudinal direction while being maintained parallel to the direction coil axis. Then, the side edges of the plate portions 50*b* and 55*b* are, respectively, engaged with the engagement portions (for example, engagement portion 12*a*) of the flange 12 while the above described protruding portions (for example, protruding portions 55*e* and 55*f*) are compressively inserted in the through holes (for example, through holes 13*c* and 13*d*) of the flange 13 and, thereby, the first and the second stationary terminals 50 and 55 are attached. Here, the shapes and the attachment structures of the first and second stationary terminals 50 and 55 are described in further detail in the following.

In the relay according to the embodiment of the present invention, the coil connection edge portions 23 and 27 of the coil terminals 21 and 25 are arranged in the space inside in the direction of the coil axis of the contact point plate portions 50*a* and 55*a* of the stationary terminals 50 and 55 which is on the inside surface of one of the flanges 13 of the spool 10. Therefore, the coil connection edge portions 23 and 27 are arranged and contained in the space that has conventionally been vacant without providing other members. As a result of this, dead space can be effectively utilized so that the entire relay can be miniaturized. In addition, at the time of the arrangement within the above space, a large insulating distance between the coil terminals 21, 25 and the stationary terminals 50, 55 can be secured while securing a large width dimension of the stationary terminals 50 and 55. Therefore, the disadvantage due to conductance between the stationary terminals and the coil terminals can be avoided so as to enhance reliability and an increase in the current capacitance (that is to say, reduction of the amount of heat emission) of the stationary terminals can be achieved.

In particular, in the embodiment of the present invention, the coil connection edge portions 23 and 27 are arranged longitudinally in the upright condition on the inside surface of the flange 13. In addition, two longitudinal direction plate portions 50*b*, 50*c* or 55*b*, 55*c* which make a right angle with each other in the stationary terminals 50, 55 are arranged so as to respectively surround these coil connection edge portions 23 and 27. Therefore, a large insulating distance can be secured while a larger width dimension (for example, W1, W2 shown in FIG. 2) of the conductive portion of the stationary terminals 50, 55 can be secured.

In addition, the grooves 13*a* and 13*b* which extend from the side surface to the inside and which, respectively, have openings on the outside and inside of one of the flanges 13 are created in the flange 13 according to the embodiment of the present invention. Then, the coil terminals 21 and 25 are attached to the above flange 13 by being engaged with these grooves 13*a* and 13*b*. As a result of this, the side of one end of each coil terminal 21, 25, which is lead out from the opening of the inner side of these grooves 13*a* and 13*b*, becomes the coil connection edge portion 23, 27. On the other hand, the side of the other end of each coil terminal 21, 25 led out to the outside from the opening on the external surface of these grooves 13*a* and 13*b* becomes the edge portion 24, 28 for the external connection. In summary, the opening of the inner side of the above grooves 13*a*, 13*b* is formed to extend within the above space.

Therefore, the positioning of the coil terminals 21 and 25 can be implemented with a simple operation wherein the members forming the coil terminals 21 and 25 are engaged deeply with the above grooves 13*a* and 13*b*. In particular, the positioning of the lead portions of, at least, the coil connection edge portions 23, 27 and the edge portions 24 and 28 for external connection from the flange 13 can be implemented and, therefore, the structure can contribute to the simplification of the assembly.

For example, in the structure where through holes are created in the positions within the above space of the flange 13 and the members forming the coil terminals 21 and 25 are inserted or are compressively inserted in these through holes for attachment, the other flange 12 becomes a hindrance and there is the risk that the attachment operation may become difficult. In the structure according to the embodiment of the present invention, however, such a hindrance at the time of assembly does not occur.

In addition, in the embodiment of the present invention, the above grooves 13*a* and 13*b* are in a form of an L shape as a whole, viewing one of the flanges 2*b* from the side. In particular, the side with the opening of the inside extends in the lateral direction parallel to the flange and the side with the opening of the outside extends in the direction of the coil axis perpendicular to the flange in the configuration. Then, the side of one end of the stationary terminals 21 and 25 is bent in the opening of the inside of these grooves 13*a* and 13*b* and extends toward the back side of the above plate portions 50*a* and 55*a* for contact points and, thereby, the coil connection edge portions 23 and 27 are formed.

Accordingly, as in the above described assembly method, first the stationary terminals 21 and 25 (of an L shape before bending) are first engaged with the above grooves 13*a* and 13*b*. After that, by bending this side of one end to form coil connection edge portions 23 and 27, these coil connection edge portions 23 and 27 can be attached to the flange 13 so as to be in a stationary condition.

That is to say, in the embodiment of the present invention, since the side of one end of the stationary terminals 21 and 25 are bent at the opening of the inner side of the grooves 13*a* and 13*b*, sufficient friction is caused between the stationary terminals 21, 25 and the flange 13. Therefore, a special configuration or operation for securing, such as compressively inserting or caulking, are unnecessary and, thus, further reduction of the production cost, or the like, can be achieved.

Here, "caulking" generally means to deform according to the plasticity of, for example, a portion of a member (primarily a member made of a metal) for the purpose of securing two, or more, members to each other. However, "caulking" in this type of electromagnetic relay usually means an attachment method for securing members to each other by making a protrusion (convex portion) provided in one member engage with and pass through a hole (including an opening such as a notch) created in the other member and, after that, by expanding the diameter of the tip of this protrusion through smashing by a press machine, or the like.

In addition, in the embodiment of the present invention as described above, the members forming the coil terminals 21 and 25 (of an L shape before bending) are attached to the flange 13 (see FIG. 4(*b*)) so that the side of one end (that is to say, the coil connection edge portion 23 and 27) is lead out from the above described space (in this case the opening of the inner side of the grooves 13*a* and 13*b* ) so as to stick out from the side of one of the flanges 13 in the lateral direction parallel to this flange 13. Then, a coil lead out wire is connected to the side of one end of the above member and the coil 20 is wound around the body portion 11 of the spool 10 and, after that, the coil lead out wire is connected to the side of the other end of the above member and soldering is carried out. Next, the assembly procedure is adopted wherein the above side of one end is bent to the inside so that the entirety of the side of one end is arranged in the above space and the coil connection edge portions 12*a* and 13*a* are formed in predetermined positions. Therefore, at the time of the winding of the coil 20, the coil connection edge portions 23 and 27 do not become a hindrance. In addition, in the case that the coil connection edge portions 23 and 27 are in a protruding condition, only these tip portions can be dipped in a solder tank for soldering and the soldering operation of the tips (lead out wire connection portions) of the coil connection edge portions 23 and 27 becomes easier.

Accordingly, at first glance the structure may seem difficult to assemble since the coil connection edge portions 23 and 27 of the coil terminals are arranged in the above described space (inside position between the flanges of the spool) positioning beneath the contact points 51 and 56. According to the embodiment of the present invention, however, a high level of ease of assembly that is the same as, or greater than, the conventional level can be secured.

Figure 13:
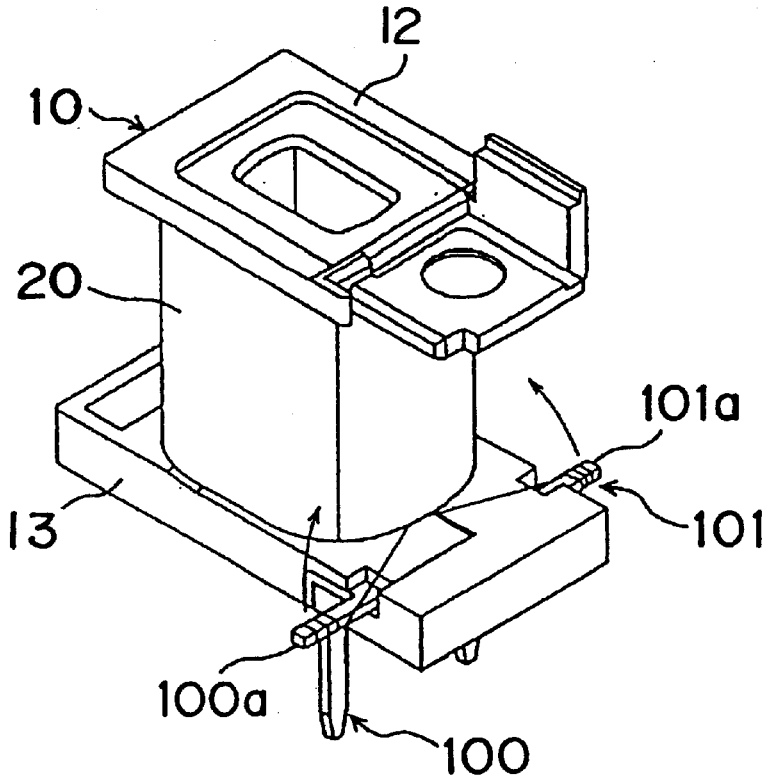
FIGS. 13*a* and 13*b* are a perspective view showing the assembly process of a comparison example of an electromagnetic relay according to the present invention.
Figure 13:
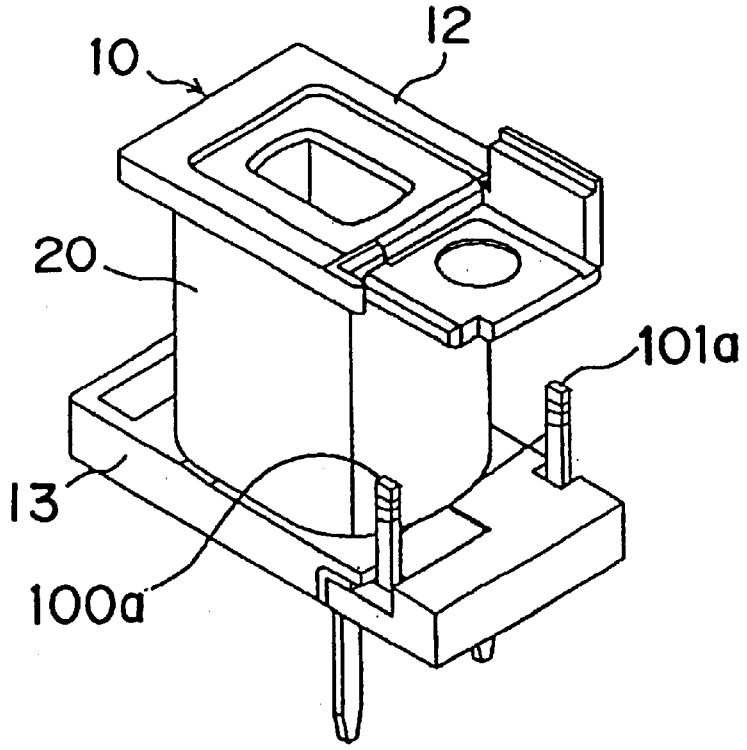
Figure 14:
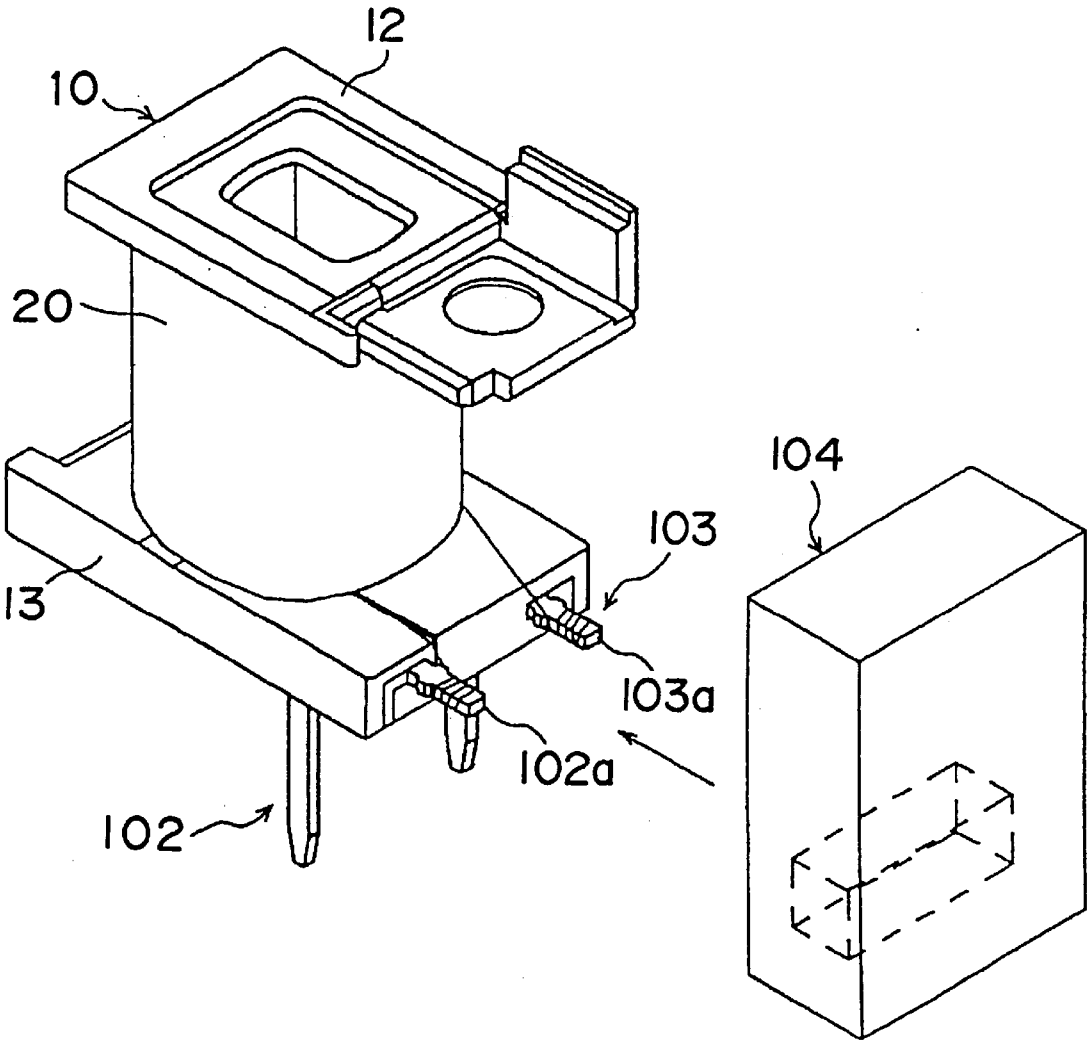
FIG. 14 is a perspective view showing another comparison example of an electromagnetic relay according to the present invention.

Here, FIGS. 13 and 14 are the figures showing comparative examples for describing the major working effects of the present invention (or the above embodiments) in a comparative manner. The same components as in the above described embodiments of the present invention are referred to by the same symbols of which the descriptions are omitted.

In the above FIG. 13 an attachment method similar to the above embodiments are adopted. That is to say, coil terminals 100 and 101 (before bending) are fit in to the grooves created in the flange 13. The winding operation of the coil and the soldering operation are carried out under the condition wherein coil connection edge portions 100*a* and 101*a* of the respective coil terminals 100 and 101 are made to, respectively, protrude on both sides of the flange 13. After that, the coil connection edge portions 100*a* and 101*a* are bent to the inside to approximately a right angle. In this configuration, the sealing of the entirety of the relay becomes possible by covering the case without providing an extra member so that the entirety can be miniaturized. However, in this case, the coil connection edge portions 100*a* and 101*a* are arranged on both ends of the flange 13. Therefore, under this condition the coil connection edge portions interfere with the longitudinal direction plate portions (for example, the above described longitudinal direction plate portions 50*b* and 55*b*) of the stationary terminals arranged in this portion. Accordingly, it is necessary to avoid such interference by providing notches in the above longitudinal direction plate portions and, as a result, the dimensions of the width of the stationary terminals must be reduced.

Contrarily, in the present invention (or in the above embodiments) the coil connection edge portions are arranged in the space inside of the inner surface of the flange 13 (that is to say, the above described space located immediately below the contact points) which was conventionally a vacant space. Therefore, there is an advantage that such an interference as described above does not occur and it is not necessary to provide notches, or the like, in the stationary terminals.

In addition, FIG. 14 shows a type which covers the coil connection edge portions protruding from the sides with another member such as in the above described second prior art. That is to say, the coil connection edge portions 102*a* and 103*a* of the coil terminals 102 and 103 are provided in the condition of protruding from the sides of the flange 13 of the spool 10 wherein this portion is covered with a separately provided cover member 104. In this case, the sealing of the entirety of the relay becomes possible by covering with a large type case which contains the entirety, including this cover member 104. However, in the second prior art, there is the disadvantage that the entire relay becomes significantly larger due to the separately provided cover member 104.

Contrarily, in the present invention (or the embodiments of the present invention) the coil connection edge portions are arranged in the above described space which was conventionally a vacant space. Therefore, the above described separate member is not at all necessary and the entire relay can be significantly miniaturized.

Here, the present invention is not limited to the above described embodiments. For example, the coil connection edge portions of the coil terminals are not necessarily stood up in the direction (that is to say, the direction of the coil axis) perpendicular to the flanges of the spool. That is to say, they may be provided so as to extend diagonally, for example, at a predetermined angle as long as a predetermined insulating distance vis-à-vis the stationary terminal is secured and no interference occurs with other members (for example, the case).

In addition, the direction in which the coil connection edge portions stick out of the coil terminals at the time of attachment (at the time when the winding operation of the coil, or the like, is carried out) is not limited to the above described embodiments and the configuration wherein they stick out in the direction as in the comparison example shown in FIG. 13 may be used. That is to say, even in the configuration as shown in FIG. 13, in the case that the final positions after the bend of the coil connection edge portions are arranged within the above described space immediately beneath the contact points, the same effects as in the embodiments of the present invention are essentially gained. Here, in the embodiments of the present invention, the two coil connection edge portions are in the protruding condition side by side on the same side of the spool and, therefore, it is advantageous for the above described soldering operation to be simultaneously carried out.

Therefore, according to the embodiments of the present invention, an electromagnetic relay can be provided wherein one of the flanges of the spool is arranged inside of the opening of the case and the coil terminal is attached to the flange of this spool next to the stationary terminal. In particular, an electromagnetic relay can be provided wherein the width dimension (current capacity) of the stationary terminal can be secured at a large value while maintaining the compactness of the entire relay and an excellent attachment or containment of the coil terminals (in particular, coil connection edge portions) are possible.

That is to say, the first characteristic feature of the present invention is in an electromagnetic relay which is covered by a case of which the side of one end is open, wherein one of the flanges of the spool around which the coil of the electromagnet is wound is arranged inside of the opening of the above case and the other flange of the above spool is arranged on the rear side of the above case and which is provided with a stationary contact point. on a plate portion for contact point of a stationary terminal which is bent to an L shape so as to extend to the rear surface of the above other flange and a coil terminal is attached to the above first flange so as to adjoin this stationary terminal, wherein a coil connection edge portion connected to the above coil of the above coil terminal is arranged in an inside space in the direction of the coil axis of the above plate portion for contact point which is on the inside of the above first flange.

Therefore, according to the first characteristic feature of the present invention the coil connection edge portions of the coil terminals are arranged in the space which is on the inside surface of one of the flanges and which is inside in the direction of the coil axis of the contact point plate portion of the stationary terminal (that is to say, the space beneath the contact points which conventionally was a vacant space). Therefore, the coil connection edge portions are arranged and contained in the conventionally vacant space without providing an extra member and, thereby, the entire relay can be made compact. In addition, the width dimension of the stationary terminal can be maintained at a large level through the arrangement of this space and a large insulating distance between the coil terminal and stationary terminal can be secured. Therefore, hindrance due to the conduction between the stationary terminal and the coil terminals can be avoided so as to enhance the reliability and the increase in current capacity (that is to say, reduction of heat emission) can be achieved.

The second characteristic feature of the present invention is in an electromagnetic relay wherein said coil connection edge portions are arranged longitudinally in the standing up condition on the inner surface of one of the above described flanges and the two longitudinal direction plate portions of the stationary terminals are arranged so as to surround said coil connection edge portions.

Therefore, according to the second characteristic feature of the relay, the coil connection edge portions are arranged longitudinally in the standing up condition on the inner surface of one of the above described flanges and are arranged so as to be surrounded by the two longitudinal direction plate portions of the stationary terminal. Therefore, a large insulating distance is secured and the width dimension of the conductive portions of the stationary terminals can be secured at a high level.

The third characteristic feature of the present invention is in of electromagnetic relay wherein a groove which extends from the side surface toward the inner side is created so as to have openings on the external and internal surface of one of the above flanges so that said coil terminals attached to the flange by being fit in to this groove where the side of one end of the above coil terminal led out to the inside from the opening on the inner surface side of this groove is made to be a coil connection edge portion and the side of the other end of the above coil terminal which is led out to the outside from the opening on the side of the external surface of this groove is made to be an edge portion for external connection so that the opening on the inner surface of the above groove is created so as to extend to the inside of the above space.

Therefore, in accordance with the relay according to Claim 3 a simple operation of engaging a member forming the coil terminal deeply in the above group, the positioning of the coil terminal (positioning of the lead portion of, at least, the coil connection edge portions and the edge portions for external connection from the flange) can be implemented and contribute to easier assembly. That is to say, for example, through holes can be created in the position of the above space of the flange so that a member for forming the coil terminal is inserted herein or attached by being compressively inserted in the structure and there is a risk that the attachment operation becomes difficult due to the hindrance of the other flange. It is, however, that according to the configuration of an embodiment of the present invention, the above described drawback existing upon assembling of operation of the relay will not be present and is easy to handle.

The fourth characteristic feature according to the present invention is in an electromagnetic relay of which the above groove is in the form of an L shape as a whole viewed from the side of one of the above flanges and is in the form where the side which has the opening to the inside extends in the lateral direction parallel to the flange and the side which has the opening to the outside extends in the direction of the toil axis perpendicular to the flange so that the side of one end of the stationary terminal is bent at the entrance of the inner surface of the above groove and extends toward the back side of the above contact point plate portion so as to form the above coil connection edge portion.

Therefore, in accordance with an electromagnetic relay according to the fourth characteristic feature, in the case that, first, the coil terminal (before bending) is engaged in the above groove and, after that, this side of one end is bent to form a coil connection edge portion as in an assembly method according to the below described fifth characteristic feature, these coil connection edge portions can be attached so as to be in the condition where they are secured at the above described flange. That is to say, in the present relay, the side of one end of the coil terminal is bent within the opening on the inside of said groove and a sufficient friction between the coil terminal and the flange occurs. Therefore, no specific configuration or work, such as compressively inserting or caulking, becomes necessary for attachment and further reduction of production costs, or the like, can be achieved.

The fifth characteristic feature according to the present invention is in an assembly method of an electromagnetic relay wherein a member forming the above coil terminal is attached so that the side of one end thereof is led out from the above space while sticking out in the lateral direction parallel to this flange from the side of the flange and, next, a coil lead wire is caught at the side of one end of this member, a coil is wound around said spool and soldering of the side of one end is carried out and, after that, said side of one end is bent to the inside so that the entirety of the side of one end is arranged in said space so that the attachment of the above coil terminal, the arrangement of the above coil connection edge portions, the winding of the coil and the connection of the coil lead wire are carried out.

In accordance with an assembly method of an electromagnetic relay according to the fifth characteristic feature, the coil connection edge portions (that is to say, the above side of one end) are not a hindrance at the time the time of the winding of the coil. In addition, in the case that the coil connection edge portions are in the protruding condition in the lateral condition, it becomes easy to dip only the tips of these portions in a solder tank for soldering. Therefore, the soldering operation of the tips of the portions (lead wire catching portion) of the coil connection edge portions also becomes easier.

In addition, the coil connection edge portions of the coil terminals are arranged within the above described space located between the flanges of the spool. Therefore, there is an advantage that the same level as the conventional level, or greater, of the ease of assembly can be secured even in the structure where assembly seems at first glance to be difficult.

Next, the first stationary terminal 50 and the second stationary terminal 55 are described in detail.

The first stationary terminal 50 and the second stationary terminal 55 are, as shown in FIG. 7, formed by the respective stationary contact points 51, 56 which are, respectively, secured to the plate portions 50*a*, 55*a* which are bent into an L shape at the edge portions of the rear side of the case. In addition, the first stationary terminal 50 and the second stationary terminal 55 respectively have plate portions 50*b* and 55*b* in the longitudinal direction which extend from the above tip portions 50*a*, 55*a* to the side of the terminal and the plate portions 50*c* and 55*c* in the longitudinal direction which extend at a right angle from the side edge of the terminal side of these plate portions 50*b* and 55*b* so as to surround the coil 20. In addition, the terminal side of the plate portions 50*c* and 55*c* is extended to provide edge portions 50*d* and 55*d* for connection as a stationary terminal. The above edge portions 50*d* and 55*d* for connection extend to the side of the case opening in comparison with the flange 13 of the spool 10 at the time of assembly so as to be connectable to a predetermined circuit conductor at the time of substrate mounting.

Here, the first coil terminal 21 and the second coil terminal 25 shown in FIG. 7 also form edge portions 24 and 28 for connection as coil terminals (edge portion 28 for connection is not shown in FIG. 7) where the side of one end extends from the side of the case opening further than the flange 13.

In addition, in order to increase the current capacity of these stationary terminals 50 and 55, it is necessary to secure large values for the width dimensions W1, W2 (shown in FIG. 2) of the longitudinal direction plate portions 50*b*, 55*b* and 50*c*, 55*c* which become a path of current from the circuit conductor of the substrate to the stationary contact points 51 and 56.

Then, the attachment structures of the first stationary terminal 50 and the second stationary terminal 55 in the embodiments of the present invention are essentially symmetrical structures as follows.

That is to say, for example, a protruding portion 55*e* which protrudes from the plate portion 55*c* to the side of the terminal and a protruding portion 55*f* which protrudes from the plate portion 55*b* to the side of the terminal are provided in the second stationary terminal 55 as shown in FIG. 7. On the other hand, through holes 13*c*, 13*d* (see FIGS. 9(*b*) and 9(*c*)), in which these protruding portions 55*e* and 55*f* are possible to be compressively inserted, are created in the flange 13 on the side of the case with the opening of the spool 10.

In addition, in the other flange (flange 12 on the rear side of the case) of the spool 10 an engagement portion 12*a* of an L shape (hook shape) which engages with the side edge of the plate portion 55*b* of the second stationary terminal 55 is provided. Thereby, the configuration is provided wherein at the time of engagement the shift in the direction shown by the symbols X1, X2, Y1 can be regulated in FIG. 9(*a*) in the range of shift in the lateral direction in the vicinity of the contact points of the second stationary terminal 55.

Figure 9:
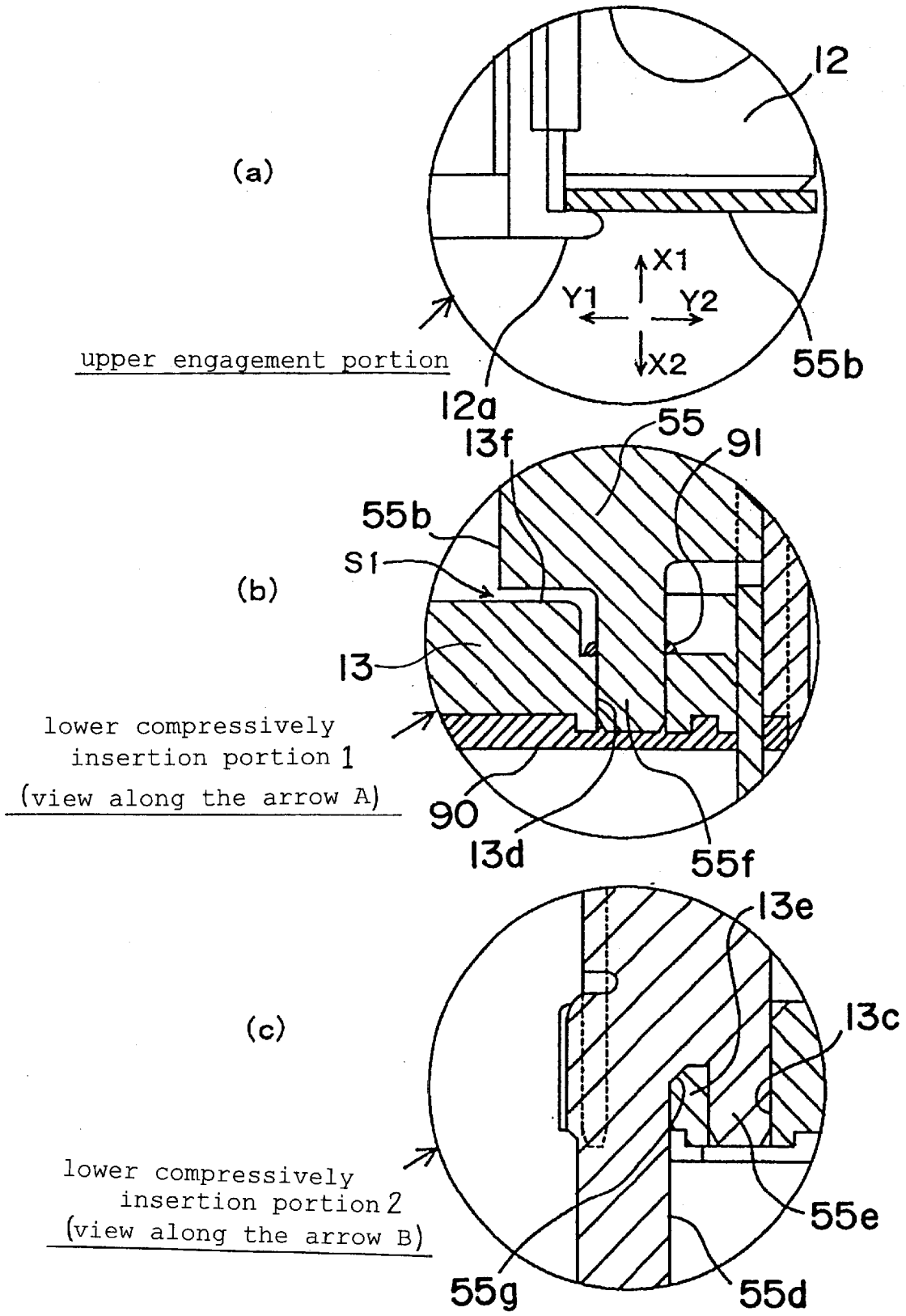
FIG. 9 is an explanatory view showing the assembled condition of the stationary terminals in FIG. 8 and FIG. 9(*a*) is a plan view showing the upper engagement portion in FIG. 8, FIG. 9(*b*) is a cross section view (view according to arrow A) showing the lower compressively inserted in portion 1 in FIG. 8 and FIG. 9(*c*) is a cross section view (view according to arrow B) showing the lower compressively inserted in portion 2 in FIG. 8.

In addition, as shown in FIG. 9(*c*) an engagement portion 13*e* which is fit in in a trough shaped portion 55*g* formed between the above protruding portion 55*e* and the above edge portion 55*d* for connection is formed in the portion adjoining the through hole 13*c* of the flange 13. Therefore, in the attachment condition of the second stationary terminal 55 this engagement portion 13*e* makes tight contact without any gaps by fitting in in the above trough shaped portion 55*g*. As a result of this, the configuration is provided wherein the shift of the second stationary terminal 55 to the direction of being compressively inserted (shift to the side with the opening of the case) is regulated.

In addition, as shown in FIG. 9(*b*), a step portion 13f formed in the position adjoining the through hole 13*d* of the flange 13 is set at the height which does not allow contact with the plate portion 55*b* of the second stationary terminal 55 in the attachment condition of the second stationary terminal 55. Thereby, a configuration is provided wherein a microscopic gap S1 is formed between the above step portion 13*f* and the plate portion 55*b*.

That is to say, as shown in FIG. 7 for example, in the case that the second stationary terminal 55 is shifted in a straight manner in the longitudinal direction while remaining parallel to the coil axis and the above protruding portion 55*e* and protruding portion 55*f* are compressively inserted in the above through holes 13*c* and 13*d*, the above engagement portion 13*e* first fits in in the above trough shaped portion 55*g*. Then, at that point in time, the dimension setting for each portion is completed so that a microscopic gap S1 (FIG. 9(*b*)) is secured between the above step portion 13*f* and the plate portion 55*b*.

In addition, the length dimensions of the plate portion 55*b*, or the like, are set so as to gain a microscopic gap S2 (shown in FIG. 8) in the condition where the second stationary terminal 55 is attached between the plate portion 55*a* (or the second stationary contact point 56) of the second stationary terminal 55 and the flange 12.

Then, in this case, the second stationary terminal 55 is simply attached as follows.

That is to say, as shown in FIG. 7 for example, the second stationary terminal 55 is shifted in a straight manner in the longitudinal direction while remaining parallel to the direction of the coil axis and the side edge of the plate portion 55*b* of the second stationary terminal 55 is engaged with the engagement portion 12*a* of the flange 12. Then, the vicinity of the center (for example, portion of the second stationary contact point 56) of the plate portion 55*a* of the second stationary terminal 55 is pressed down and the protruding portions 55*e* and 55*f* of the second stationary terminal 55 are, respectively, compressively inserted into the through holes 13*c* and 13*d* of the flange 13.

At this time, at the point in time when the above engagement portion 13*e* fits into the above trough shaped portion 55*g* (at the point in time when the shift of the protruding portion 55*e* in the direction of being compressively inserted is regulated) the entire shift of the second stationary terminal 55 in the longitudinal direction is blocked. However, since the above described gap S1 is secured in the configuration when it is in the assembled condition, the shift itself of the protruding portion 55*f* in the direction of being compressively inserted is not blocked. Therefore, by using the protruding portion 55*e* or the engagement portion 13*e* as a fulcrum, such a movement as the rotation of the second stationary terminal in the direction of Y1 in FIG. 9(*a*) is permitted. Accordingly, in the case that the second stationary terminal 55 is pushed in with a predetermined pressure at the position inside of the protruding portion 55*e* (for example, in the vicinity of the center of the plate portion 55*a*), which is positioned in the lateral direction of the second stationary terminal 55, the above rotation is in practice blocked by the above engagement portion 12*a* so as to settle in a predetermined assembly position (in this case, the standing up condition along the direction of the coil axis). In this case, however, by using the axis core of the protruding portion 55*f* as a fulcrum, a torque proportional to the pressure occurs in the above rotational direction based on the reaction at the protruding portion 55*e*. Then, after releasing the pressure for the assembly operation (compressively inserting operation) the friction caused at the time when the protruding portion 55*e* is compressively inserted in the through hole 13*c* (or force of attachment by the sealing material 90) works as a holding force and gives force to the second stationary terminal 55 so as to move in the above rotational direction. That is to say, the above friction remains as a moment of force (that is, torque) of which slightly deforms the flange 12, or the like, in an elastic manner.

Consequently, such an attachment structure as in above embodiments, the second stationary terminal 55 is kept in a condition wherein it is supported by three points consisting of two pushed in portions and the engagement portion 12*a*. In addition, the second stationary terminal 55 is in the condition which is always oppressed by the above described remaining torque into the direction of Y1 in FIG. 9 (*a*) (direction to prevent the separation from the engagement portion 12*a*) in the above attached condition so as to be stationary engaged in the condition where the torque is received by the reaction of the engagement portion 12*a*.

As for a method to gain the above force, it is not limited to the above described method and, for example, by providing a protrusion for pushing in the protruding portion 55*e*, the second stationary terminal 55 may be given force. Or, by making the above terminal portion 55*f* protrude in a diagonal direction so as to apply pressure to the above compressively inserted in portion 13*d*, the above force may be gained.

Here, the attachment structure and the attachment method of the second stationary terminal 55 is described in the above and the attachment structure of the first stationary terminal 50 has the same structure (detailed description or illustration using symbols is omitted). In this connection, a gap S3 (showing FIG. 8) similar to the above gap S2 is provided according to a design value between the longitudinal direction plate portion 12*b* (shown in FIGS. 7 and 8) of the flange 12 positioned inside of the plate portion 50*a* of the first stationary terminal 50 and the above plate portion 50*a*.

The above relay is assembled of all of the components except for the case 80 with the flange 13 in the center in the same manner as in the above described first and second stationary terminals 50 and 55. Then, finally, the case 80 is placed to cover the sub-assembly formed in the above manner. After that, the opening of the case 80 is sealed with a sealing material 90 (shown in FIG. 9(*b*)) such as a heat curing resin (for example, an epoxy resin) so as to complete the assembly. Then, the above through holes 13*c* and 13*d* are through holes which open onto the side with the opening of the case of the flange 13. Therefore, the sealing material 80 enters into the gaps of these through holes 13*c* and 13*d* according to capillary tube action and due to gravity. As a result of this, a portion to which the sealing material flows into is formed as denoted by the symbol 91 in FIG. 9(*b*). Here, such a condition is the same concerning to compressively inserted in portion shown in FIG. 9(*c*). However, since it becomes too complicated, the sealing material is omitted in FIG. 9(*c*).

The above sealing material 90 is usually filled in as follows. That is to say, after attaching the case 80, the side with the opening of the case of relay is directed upward in the vertical direction. Then, a predetermined amount of sealing material 90 (in the condition before being cured) is dropped in or is made to flow in to the side with the opening of this case. As a result of this, the sealing material 90 enters into all of the gaps on the side of the case with the opening according to natural fluid action due to gravity and capillary tube action and a sealing layer of which the surface is flat is formed on the inside of the opening of the case. After that, for example, the entire relay is placed in a curing tank which heats up the sealing material 90 at a curing temperature, or more, and maintains the temperature for a predetermined period of time so as to cure the sealing material 90.

As described above, according to the relay of the present invention, protruding portions (for example, protruding portions 55*e* and 55*f*) which extend from respective stationary terminals 50 and 55 to the opening side of the case is compressively inserted in to the holes (for example, through holes 13*c* and 13*d*) formed in one of the flanges 13 of the spool 10 which is arranged on the side of the case with the opening. On the other hand, respective stationary terminals 50 and 55 are attached to the spool 10 by engaging the vicinity of the stationary contact point (side end of the edge portion on the rear side of the case of the plate portions 50*b* and 55*b*) with the engagement portion (for example, engagement portion 12*a*) formed on the other flange arranged on the rear side of the case.

Thereby, every stationary terminal is supported by both edge portions of the spool. Therefore, sufficient positioning precision can be attached without increasing space for attaching it fixedly through thicker flange 13. In addition, respective stationary terminals are not compressively inserted in the spool in the vicinity of the contact points but, rather, they are merely supported by simple engagement. Therefore, the possibility of shavings (dust), which has been caused by compressive insertion in entering between the contact points so as to cause contact point obstruction is significantly reduced.

In particular, in the present invention, the hole of one of flanges 13, to which the above protruding portion is compressively inserted, is created as a through hole which opens onto the side of the case with the opening and a sealing material is made to enter into the gap between this through hole and the above protruding portion. Therefore, the majority of the dust caused by compressive insertion in this protruding portion is solidified by the sealing material and is blocked from shifting to the rear side of the case. As a result, the possibility of the occurrence of contact point obstruction due to dust is further reduced. In addition, the above protruding portion which is compressively inserted is secured more solidly due to the adhesive effect of the sealing material. Thereby, an appropriate fit in condition is maintained with a high reliability and the positions of the stationary terminals are maintained in an appropriate condition with greater stability.

In addition, in the present invention, the above engagement portion regulates only the shift in the lateral direction of the above stationary terminals and the above stationary terminals are, at least, movable relative to this engagement portion in the direction of coil axis. More concretely, in the case of second stationary terminal 55, for example, the above described engagement portion 12*a* only regulates the shift of the plate portion 55*b* of the second stationary terminal 55 in the lateral direction and the above described gap S2 is provided. Therefore, the second stationary terminal 55 (in particular, portion of the second stationary contact point 56) can be shifted relative to the flange 12 in the direction of the coil axis.

As a result of this, even in the case that the flange 12 is deformed and warped into the form of a curved surface by the above described pressure in the direction of the coil axis, the flange 12 displaces relative to the second stationary terminal 55 in the direction that reduces the gap S2 so as to avoid this deformation. Accordingly, no disadvantage occurs wherein the second stationary terminal 55 (in particular, portion of the second stationary contact point S6) is displaced upward together with the above described deformation. That is to say, the displacement of the stationary contact points in the direction of the axis which has the greatest effects on the contact point pressure is nullified so that the contact point characteristics are significantly stabilized.

In particular, in the embodiment of the present invention, the rear side of the case of the stationary terminals (that is to say, the vicinity of the stationary contact points) are continuously pressed in the direction so as to engage with the engagement portion 12*a* because of the above described remaining torque. Therefore, the attachment condition, having the configuration wherein the vicinity of the stationary contact points is not compressively inserted into the flange, of the stationary terminals wherein it is impossible for the resultant stationary terminals to shift in either direction along the lateral direction (none of the directions X1, X2, Y1, Y2 in FIG. 9(*a*)) is gained. As a result of this, the positional shift of the stationary contact points in the lateral direction hardly occurs and stability of the contact point characteristics is achieved in regard to this point.

Here, the present invention is not limited to the above embodiments. For example, the configuration wherein the above described remaining torque occurs is not always necessary. That is to say, the positional shift of the contact points in the lateral direction does not have such negative effects as described above and, in the case that where allowable, for example, it is possible to place the compressively inserted in portions on the side of the case with the openings of the stationary terminals in one location.

In addition, theoretically an embodiment may be implemented where the compressively inserted in portions of the stationary terminals on the side of case with the opening or the engagement portions of the rear. side of the case (in the vicinity of the stationary contact point) are additionally provided in a large number.

Furthermore, "rotation" in the present invention is not necessarily limited to a rotational movement with one axis line in a strict sense but, rather, includes, of course, an embodiment where the stationary terminal moves so as to tilt.

Then, the coil terminals and the stationary terminals are not necessarily attached through the above described translation in a linear manner. Furthermore, the assembly is not limited to an automatic assembly by machine but may be an assembly by manual operation. Here, in the case that the attachment through the translation in a linear manner is possible as in the above embodiments, automatic assembly becomes easy so as to improve productivity.

In addition, in the case of the configuration as in the above embodiments, the gaps S1, S2 and S3 as described in the above embodiments may not, necessarily, exist in the condition of the actually completed assembly. That is to say, the above described gaps S1, S2 and S3 are based on design dimensions which do not take the deformation of members (elastic deformation and plastic deformation) into consideration and, in practice, the deformation of the flanges, or the like, of the spool is absorbed in these gaps so that the above gaps S1, S2 and S3 can result with zero value.

The above embodiments are examples wherein the present invention is applied to the so-called c contact point-type (type having both the a contact point and the b contact point) electromagnetic relay. However, the present invention can, of course, be applied in the same manner to an a contact point-type which has only an a contact point and to a b contact point-type which has only a b contact point.

Figure 10:
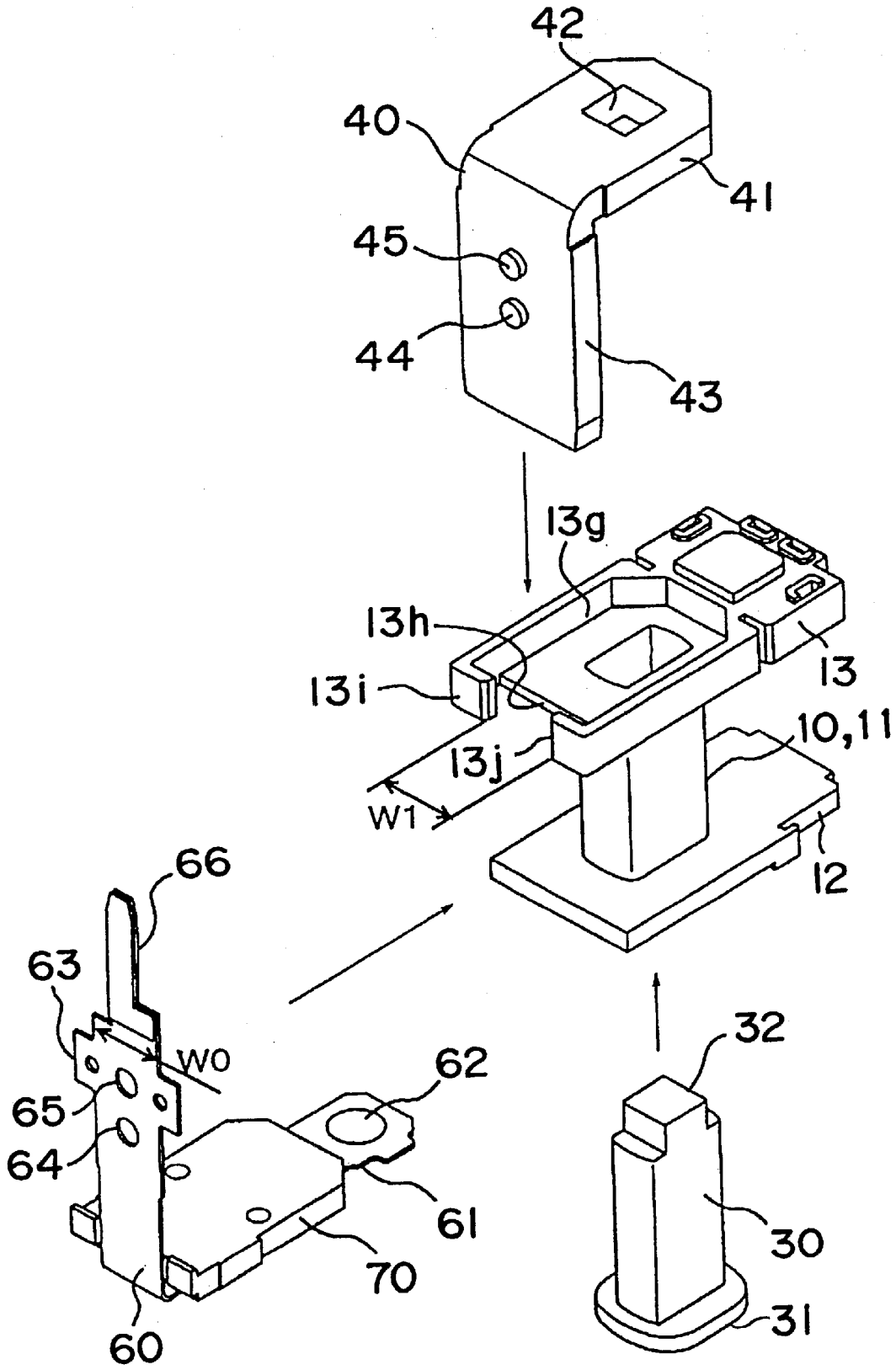
FIG. 10 is an exploded perspective view showing the second embodiment.
Figure 11:
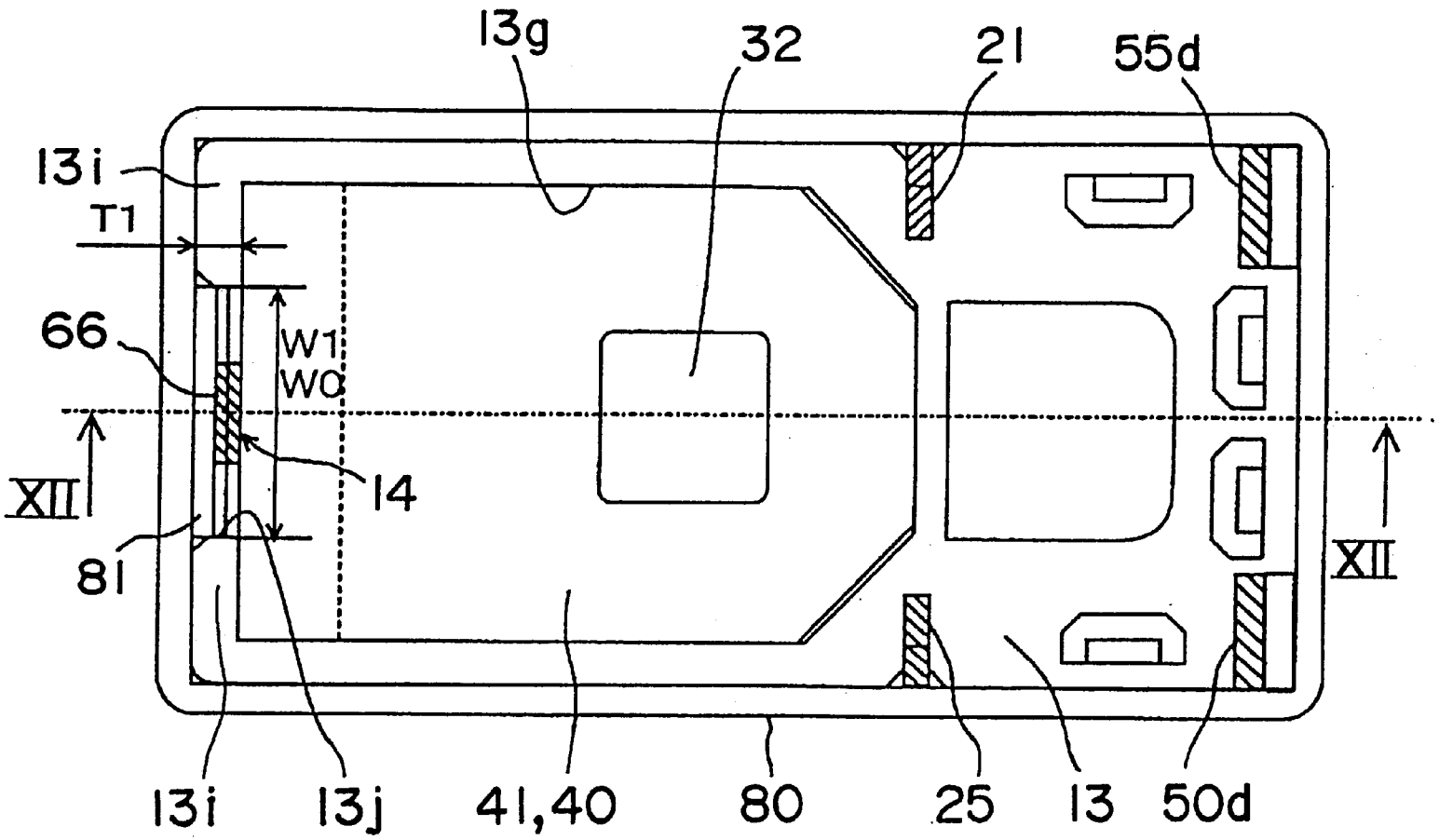
FIG. 11 is a bottom surface view of the second embodiment.
Figure 12:
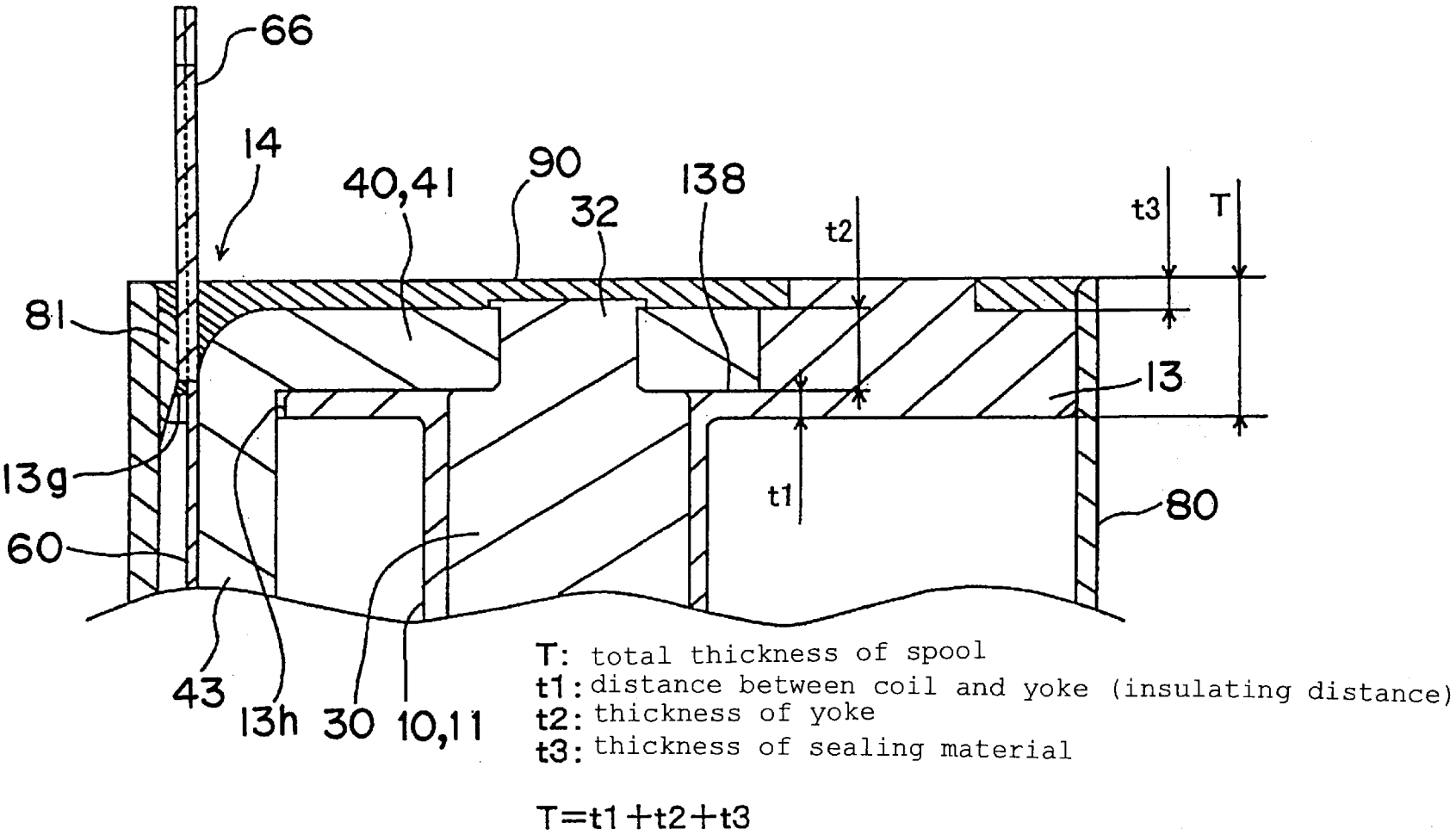
FIG. 12 is a cross section view along line XII—XII of FIG.

The second embodiment is similar to the above described first embodiment as shown in FIGS. 10 to 12. Therefore, the same numerals are attached to the same portions for the description.

The specific characteristic feature of the present invention is the attachment structure of the yoke 40 to the spool 10.

That is to say, the above yoke 40 has a lateral direction plate portion 41 and a longitudinal direction plate portion 43. The above lateral direction plate portion 41 is fit in to a concave portion 13*g* which is formed on the external surface of the flange 13, which is positioned on the side of the case with the opening of the spool 10, and is connected to a portion 32 of one end of the iron core 30 by means of caulking. In addition, longitudinal direction plate portion 43 extends from the opening 13*h* of a rectangular shape created on the bottom surface of the above concave portion 13*g* of the flange 10 to the rear end of the case along the direction of coil axis.

In addition, the movable contact point spring 60 is a spring for making a recovery force work on the movable iron piece 70 and functions as a movable terminal for connecting the movable contact point 62 to a predetermined circuit conductor. This movable contact point spring 60 has the above described lateral direction plate portion 61 and longitudinal direction plate portion 63 wherein a protrusion 44 for caulking formed on the yoke 40 (longitudinal direction plate portion 43) as well as a protrusion 45 for stopping rotation are, respectively, fit into a hole 64 for caulking and a hole 65 for stopping rotation created in the longitudinal direction plate portion 63. Then, by caulking the tip of the protrusion 44 for caulking, the movable contact point spring 60 is secured on the yoke 40 (longitudinal direction plate portion 43) preventing rotation.

Furthermore, a notch 13*j* is created so as to face the above concave portion 13*g* and the opening 13*h* on the surface of the side on which the above longitudinal direction plate portion 43 is placed in the flange 13 of the spool 10. By surrounding this notch 13*j* with the inner surface of the case 80 and the external surface of the yoke 40, a window 14 in a slit form is created (shown in FIGS. 11 and 12). Here, the width dimension of this window 14 (that is to say, the width dimension W1 of the notch 13*j*) is set at the dimension slightly larger than the width dimension W0 (FIGS. 10 and 11) of the side of one end of the movable contact point spring 60 (that is to say, the base edge side of the edge portion 66 for connection) which is fit into the window as described below. In addition, the thickness T1 (shown in FIG. 11) of the L shaped plate portions 13*i* of the spool 10 formed on both sides of the above window 14 is set at a value slightly larger than the total value of the thickness of the below described convex portion 81 of the case 80 and the thickness of the edge portion 66 for connection. Thereby, the below described sealing material 90 which has flown into the above window 14 enters into these gaps in an appropriate manner.

Then, a belt plate portion on the side of the case with the opening of the movable contact point spring 60, the first stationary terminal 50 and the second stationary terminal 55 extend so that the tip protrudes out of the opening edge of the case 80 in the same manner as the first coil terminal 62 or the second coil terminal 63. Then, edge portions 66, 50*d* and 55*d* (shown in FIGS. 11 and 12) for connecting respective contact points to predetermined circuit conductors on the substrate are, respectively, formed. Here, in FIG. 12, edge portions 50*d* and 55*d* for connection and the first coil terminal 50 as well as the second coil terminal 55 are omitted in the figure.

In addition, the above relay is assembled of all of the components except for the case. 80 with the flange 13 in the center and, finally, the case 80 is placed to cover the sub-assembly formed in such a manner. After that, the opening of the case 80 is sealed with a sealing material 90 (shown in FIG. 12) such as a heat curing resin (for example, an epoxy resin) so as to complete the assembly. In the present invention, the sealing material 90 is filled in within the above window 14.

Here, the assembly of the major components onto the spool 10 can be-easily carried out as in the following example.

That is to say, as shown in FIG. 10, first, the yoke 40 is transferred in a linear manner in the longitudinal direction from the side of the case with the opening and the tip of the longitudinal direction plate portion 43 is inserted into the opening 13*h*. Next, the longitudinal direction plate portion 43 is further passed into the opening 13*h* so that the lateral direction plate portion 41 is fit into the concave portion 13*g* and the yoke 40 is positioned in the spool 10.

Next, the iron core 30 is passed into the through hole 11*a* created in the body portion 11 of the spool 10 from the rear side of the case so that the protrusion 32 for caulking at the tip of the iron core passed through the hole 42 created in the yoke 40 (lateral direction plate portion 41). Then, by caulking the tip of the protrusion 32 for caulking, the iron core 30 and the yoke 40 are secured to the spool 10.

After that, the movable contact point spring 60 (as well as the movable iron piece 70) is transferred in a linear manner in the lateral direction toward the notch 13*j* of the above spool 10 and the longitudinal direction plate portion 43 of the above yoke 40 from the side of the above spool. Then, the side of one end of the movable contact point spring 60 (base edge side of the edge portion 66 for connection) is fit into the notch 13*h* and, at the same time, the protrusion 44 for caulking and the protrusion 45 for stopping rotation are, respectively, fit in to the hole 64 for caulking and the hole 65 for stopping rotation created in the movable contact point spring 60. Finally, by caulking the protrusion 44 for caulking, the movable contact point spring 60 (and the movable iron piece 70) is attached to the spool 10.

In this case a convex portion 81 is formed on the inside of the opening of the case. This convex portion 81 fits into the notch 13*j* of the spool 10 and contacts (or faces with a slight gap in between) the side of one end of the movable contact point spring 60 (that is to say, the above described base edge side of the edge portion 66 for connection). Accordingly, the above described edge portion 66 for connection is passed through the window 14 surrounded by the notch 13*j*, the case 80 and the yoke 40 as described above leaving a slight gap. Therefore, the sealing material 90 enters into the above gap in an appropriate manner. And, the above sealing material 90 can be filled in in the same manner as described above.

In this manner, in the relay of the embodiment of the present invention, a notch 13*j* is formed on the side of one of the flanges 13 of the spool 10 so as to face the concave portion 13*g* into which the yoke 40 is fit and the opening 13*h*. Then, the side of one end of the movable contact point spring 60 (edge portion 66 for connection) is placed in the condition of passing through the window 14, formed by surrounding this notch 13*j* with the case 80 and the yoke 40. Furthermore, the sealing material 90 is filled in within this window 14 in this configuration.

That is to say, in the present embodiment, a lead portion of the edge portion 66 for connection is formed and this lead portion is sealed. Therefore, it is not necessary to increase the total thickness T of the spool shown in FIG. 12 so that the dimension in the height direction of the entire relay can be maintained to be compact.

In addition, at the time of the attachment of the movable contact point spring 60, the operation of passing the side of one thereof through a narrow gap becomes unnecessary and assembly becomes significantly easier even in the manual assembly operation. In addition, not only the yoke 40 and the iron core 30 but, also, the movable contact point spring 60 can be transferred in a linear manner, for example, in the lateral direction as described above in order for assembly. Therefore, an automatic assembly becomes possible and high productivity (low production cost) can be realized even in a country of manufacture where labor costs are high.

In addition, in the present invention, the width dimension W1 of the above notch 13*j* is set at a value slightly larger than the width dimension W0 of the side of one end (edge portion 66 for connection) of the movable contact point spring 60 which is positioned within the above notch 13*j*. Furthermore, a convex portion 81 which fits in within the above notch 13*j* and which contacts or faces the external surface of the side of one end (edge portion 66 for connection) of the movable contact point spring 60 is formed on the inside of opening of the case 80. Then, a microscopic gap into which the sealing material 90 enters in an appropriate manner is set between the inner peripheral surface of the above window 14 and the external peripheral surface of the side of one end (edge portion 66 for connection) of the above movable contact point spring 60. Thereby, the sealing material 90 can be prevented, without fail, from disadvantageously flowing excessively to the inside from the gap of the lead portion (that is to say, window 14) of the edge portion 66 for connection.

In addition, there is an advantage that the thickness T1 (FIG. 11) of the L shaped plate portions 13*i* of the spool 10 positioned on both sides of the window 14 need not be made excessively small because of the existence of the convex portion 81 of the case 80. This is because spool 10 is required to be formed of an insulating material and is conventionally processed as a mold of a synthetic resin. However, in general, the minimum dimension of thickness that can be practically formed as a mold of a synthetic resin is usually approximately 0.4 mm according to the present state of technology and it is extremely difficult to form the mold with the thickness of that level or less. Therefore, it is necessary to design the spool with a dimension larger than this minimum limit dimension in order to make the manufacturing cost as low as possible. As described above, however, the thickness of the edge portion for connection of a terminal in this type of relay is as thin as, for example, 0.3 mm. That is to say, the thickness of the edge portion 66 for connection that is passed through the window 14 is less than the present minimum limit dimension of the above resin mold. Therefore, in the case when the thickness of the window 14 is made to be equal to the thickness T1 of the above L shaped plate portion 13*i* in the configuration wherein the convex portion 81 is not provided, a comparatively large gap of, for example, approximately 0.1 mm, may be made even T1 is set above the limiting dimension. As a result, there is a risk that the management of the appropriate amount of entrance of the sealing material 90 becomes difficult. Contrarily, in the case that it is attached to make this gap small approaching the optimal value, it becomes necessary to make the thickness T1 of the above L shaped plate portions 13*i* close to the minimum limit dimension, or less, of the resin mold and the problem arises that practical production becomes impossible. In the present invention, however, by securing a considerable degree of thickness of the above convex portion 81, the thickness T1 of the above L shaped plate portions 13*i* can be set at the minimum limit dimension value (or a value larger than that) of the resin mold.

In addition, in the embodiment of the present invention as shown in FIG. 10, the protrusion 44 for caulking and the protrusion 45 for stopping rotation formed on the external surface of the longitudinal direction plate portion 43 of the yoke 40 are arranged side by side longitudinally along the center line of the longitudinal direction plate portion 43. Then, the position of these protrusions 44 and 45 in lateral direction is set within the width dimension W1 of the above described notch 13*j*. Therefore, the above notch 13*j* also functions to form a space (margin) for avoiding interference between the above protrusions 44, 45 and the spool 10 at the time when the yoke 40 is attached as described above by being shifted in a linear manner in the longitudinal direction. As a result of this, it becomes unnecessary to separately provide the above margin and there is the effect that costs can be reduced. In addition, in the case that the margin as described above is separately provided, the sealing material enters into the relay from this margin in an excessive manner and there is a risk that it may become a disadvantageous factor such as malfunction. Though some measurement may be required in some cases, in the case of the embodiment of the present invention there is the characteristic feature that there is no such risk of disadvantage.

Here, the present invention not limited to the above embodiments. For example, the convex portion 81 (convex portion fit in within the notch 13*j*) on the inside of the opening of the case 80 is not necessarily required. This is because it is not necessary in the case that the thickness dimension of the edge portion for connection of the terminals is larger than the minimum limit dimension of the above described resin mold or in the case that an excessive entrance of the sealing material does not occur even when the gap of terminal lead out portion increases slightly due to the non-existence of the convex portion (in the case that the viscosity of the sealing material is high).

In addition, the L shaped plate portions 13*i* in the above described embodiments are not necessarily required. For example, in the case that the width dimension W0 of the side of one end (base edge side of the edge portion 66 for connection) of the movable contact point spring 60 which fits into the notch 13*j* becomes the same as the width dimension of the yoke 40 (that is to say, in the case that the width dimension W1 of the notch 13*j* is the same as the width dimension of the concave portion 13*g*), the above L shaped plate portions 13*i* are lost as a result. In this case, however, an excessive entrance of the sealing material can be blocked without these L shaped plate portions 13*i*.

In addition, the movable contact point spring (movable terminal) is not necessarily attached by being transferred in a linear manner as described above. In addition, it is not limited to an automatic assembly by a machine but it may be attached through a manual operation. In a configuration wherein the edge portion for connection of the movable contact point spring is arranged in the notch in the condition of penetration such as in the present invention, the movable contact point spring can be easily attached by fitting in the above edge portion for connection to this notch before the attachment of the case. Therefore, attachment is possible not only through translation in a linear manner. In addition, since troublesome and difficult operations are unnecessary such that this edge portion for connection is attached by being passed through the window in a slit form (narrow gap), assembly is easy even in the case of assembly through manual operation.

In addition, components other than the movable contact point spring may, of course, be assembled through manual operation without being limited to automatic assembly by a machine. Here, a relay according to the present invention does not have problems which hinder automatic assembly and can advantageously keep production costs low by, for example, carrying out an automatic assembly in a country of manufacture where labor costs are high.

Furthermore, the above described embodiment is an example wherein the present invention is applied to a so-called c contact point-type (type which has both the a contact point and the b contact point) electromagnetic relay. However, the present invention can, of course, be applied in the same manner to the a contact point-type which has only the a contact point and the b contact point-type which has only the b contact point.

Therefore, in accordance with the embodiment of the present invention, an electromagnetic relay can be provided wherein one of the flanges of the spool is arranged inside of the opening of the case and the side of this case with the opening is sealed with a sealing material. In particular, an electromagnetic relay can be provided wherein the configuration of the lead portion of the movable terminal, which is formed integrally with the movable contact point spring and which is arranged in the form of protruding from the opening of the case, is improved and the filling in condition of the sealing material is maintained in an excellent manner and, moreover, the ease of assembly of, at least, the movable contact point spring is improved without an accompanying increase in the overall height dimension.

Practically, the first characteristic feature of the electromagnetic relay according to the embodiments of the present invention is, in an electromagnetic relay of which the side of one end is covered with a case with an opening wherein one of the flanges of the spool around which a coil of an electromagnet is wound is arranged inside of the opening of said case and a lateral direction plate portion of an L shaped yoke is fit into a recess created on the end side of this first flange so that a longitudinal direction plate portion of this L shaped yoke is arranged so as to extend from an opening created on the bottom surface of the recess of the above first flange to the side of the other flange of said spool along the direction of the coil axis of said spool and wherein a movable contact point spring is secured to outer surface of the longitudinal direction plate portion of said yoke so that the side of one end of this movable contact point spring extends from the opening of said case in a protruding condition so as to form an edge portion for connection of the movable contact terminal and which is sealed by filling in a sealing material in the inside of the opening of said case, a notch facing said recess and the opening is created on the surface of the side where said longitudinal direction plate portion is arranged in the above first flange and this notch arranges the side of one end of said movable contact point spring into the condition of penetration through a window surrounded by said case and the yoke and said sealing material is filled in within said window.

According to the first characteristic feature, a notch facing the concave portion and the opening to which the yoke is fit in is created on the side of one of the flanges of the spool. Then, the side of one end of the movable contact point spring (edge portion for connection of the movable terminal) is past through the window formed by surrounding this notch with the case and the yoke and the sealing material is filled in within this window in this configuration. That is to say, according to the present invention, the lead portion of the edge portion for connection of the movable terminal is formed and this lead portion is sealed.

Therefore, the dimension in the height direction of the entire relay is not required to be increased and it can be maintained of a compact size. Additionally, at the time of attachment of the movable contact point spring, the operation of passing the side of one end thereof through a narrow gap is unnecessary and, therefore, assembly becomes significantly easier even in the case of manual operation.

In addition, according to the embodiments of the present invention, the movable contact point spring before the attachment of the case can be attached by being transferred in a liner manner in the lateral direction, which makes the assembly easy. Therefore, an automatic assembly becomes possible so as to achieve a high productivity (low production costs).

The second characteristic feature of the present invention is the setting of the gap between the inner peripheral surface of the above window and the external peripheral surface of one end of the above movable contact point spring as a microscopic gap into which the above sealing material appropriately enters.

According to the second characteristic feature, the width dimension W1 of the above notch is set at a value slightly greater than the width dimension W0 of the side of one end of the movable contact point spring which is positioned within the above notch. That is to say, the gap between the inner peripheral surface of the above window and the external peripheral surface of the side of one end of the above movable contact point spring is set so as to be a microscopic gap into which the sealing material appropriately enters. Thereby, the disadvantage can be prevented without fail wherein the sealing material flows into the inside in an excessive manner from the gap of the lead portion (that is to say, the above window) of the edge portion for connection of the movable terminal.

The third characteristic feature of the present invention is the forming of a convex portion, which fits in within the above notch and which contacts or faces the external surface of the side of one end of the above movable contact point spring, inside of the opening of the above case.

According to this third characteristic feature, in the case that plate portions (for example, portions such as L shaped plate portions **13*i* of the above embodiment) of the spool are formed on both sides of the window, there is an advantage that the thickness T1 of these plate portions need not be made excessively small. This is because it is necessary to form the spool of an insulating material and it is usually produced as a mold of a synthetic resin. However, the minimum dimension of thickness of a mold of a synthetic resin which can be practically molded is, in general, normally approximately 0.4 mm according to the present state of technology and it is very difficult to make it less than that. Therefore, in order to make the manufacturing cost less expensive it is necessary to design the dimensions to be larger, to as great a degree as possible, than this minimum limit dimension. However, as described above, the thickness of the edge portion for connection of the terminals in this type of relay is, for example, as thin as 0.3 mm. That is to say, the thickness of the above edge portion for connection which is passed through the window is, at present, at the minimum limit dimension, or less, of the above resin mold. Therefore, when the thickness of the window is made equal to the thickness Ti of the above plate portion in the configuration where the above convex portion is not provided, a comparatively large gap of, for example, approximately 0.1 mm is created even in the case that this T1 is assumed to be set at the above minimum limit dimension. As a result of this, there is the risk that it may be difficult to appropriately manage the entrance of the sealing material. Contrarily, in the case that it is attempted to make this gap smaller to approach the optimal value, it becomes necessary to make the thickness T1 of the above plate portion close to the minimum limit dimension, or less, of the resin mold and the problem arises that practical production, or the like, becomes impossible. However, in the present invention the thickness T1** of the above plate portion can be set at the minimum limit dimension, or more, (or at a value greater than this) of the resin mold by securing a considerable amount of the thickness of the convex portion.

The fourth characteristic feature of the present invention is the formation of, at least, either the protrusion for caulking which attaches the movable contact point spring to the external surface of the longitudinal direction plate portion of the above yoke or the protrusion for stopping rotation which prevents the rotation of the movable contact point spring so that the position of these protrusions in the lateral direction perpendicular to the direction of the coil axis is set within the width dimension of the above notch.

Therefore, in accordance with the fourth characteristic feature, the attachment (or the stopping of rotation) of the movable contact point spring to the yoke becomes easy and there is the effect that the problem of interference of these protrusions at the time of assembly can be easily solved.

Specially, at the time when the yoke is attached by being shifted in a linear manner, for example, in the longitudinal direction so as to fit in to the concave portion and the opening of one of the flanges of the spool, the above notch functions as a space (margin) for avoiding the interference between the above protrusions and the spool. Therefore, it becomes unnecessary to separately provide a specific structure and there is the effect that costs can be reduced. In addition, in the case that a margin is separately provided, there is a risk that the sealing material may enter into the inside of the relay from this margin in an excessive manner so as to cause disadvantages such as malfunctions. According to the present invention, however, there is no such risk and this characterizes the present invention.

The fifth characteristic feature of the embodiments of the present invention is a method of assembly for an electromagnetic relay wherein the above movable contact point spring is attached by transferring the above movable contact point spring in a linear manner in the direction from the side of the above spool, where the above yoke is attached to the spool, toward the external surface of the above notch and the above longitudinal direction plate portion in the lateral direction perpendicular to the direction of coil axis so that the above movable contact point spring is attached to the external surface of the above longitudinal direction plate portion while fitting in the side of one end of the movable contact point spring to the above notch.

INDUSTRIAL APPLICABILITY

The present invention relates to a relay, in particular, to an electromagnetic relay where one of the flanges provided on both sides of the spool is also used as a base.

What is claimed is:

1. An electromagnetic relay of which the side of one end is covered with a case with an opening wherein one of the flanges of the spool around which a coil of an electromagnet is wound is located inside of the opening of said case and a lateral direction plate portion of an L shaped yoke is attached into a recess formed on the end side of this first flange so that a longitudinal direction plate portion of this L shaped yoke is arranged so as to extend from an opening provided on the bottom surface of the recess of the first flange to the side of the other flange of said spool along the direction of the coil axis of said spool and wherein a movable contact point spring is secured to outer surface of the longitudinal direction plate portion of said yoke so that the side of one end of the. movable contact point spring extends from the opening of said case in a protruding condition so as to form an edge portion for connection of the movable contact terminal and which is sealed by filling with a sealing material in the inside of the opening of said case, wherein the electromagnetic relay is characterized in that a notch facing said recess and the opening is provided on the surface of the side where said longitudinal direction plate portion is arranged in the above first flange and this notch arranges the side of one end of the movable contact point spring into the condition of penetration through a window surrounded by said case and the yoke and said sealing material is filled within said window.

* * * * *